US005307652A

United States Patent [19]

Hagiwara et al.

[11] Patent Number: 5,307,652

[45] Date of Patent: May 3, 1994

[54] CONTINUOUS WASHING MACHINE

[75] Inventors: Haruo Hagiwara; Hiroyuki Asaoka; Toshio Hattori; Akira Maeda, all of Nagoya, Japan

[73] Assignee: Mitsubishi Jukogyo Kabushiki Kaisha, Tokyo, Japan

[21] Appl. No.: 981,001

[22] Filed: Nov. 24, 1992

[30] Foreign Application Priority Data

| | | | |
|---|---|---|---|
| Nov. 28, 1991 | [JP] | Japan | 3-314922 |
| Dec. 2, 1991 | [JP] | Japan | 3-317732 |
| Dec. 5, 1991 | [JP] | Japan | 3-321749 |
| Dec. 5, 1991 | [JP] | Japan | 3-321750 |
| Dec. 6, 1991 | [JP] | Japan | 3-322892 |
| Jan. 13, 1992 | [JP] | Japan | 4-004053 |

[51] Int. Cl.[5] ..... D06F 31/00

[52] U.S. Cl. ..... 68/27; 68/145

[58] Field of Search ..... 68/27, 58, 143, 145, 68/158

[56] References Cited

U.S. PATENT DOCUMENTS 4,519,224 5/1985 Seifert et al. ..... 68/27 X

FOREIGN PATENT DOCUMENTS

| | | | |
|---|---|---|---|
| 0509931 | 10/1992 | European Pat. Off. | 68/27 |
| 1460822 | 3/1969 | Fed. Rep. of Germany . | |
| 2424509 | 1/1975 | Fed. Rep. of Germany | 68/145 |
| 2912183 | 10/1980 | Fed. Rep. of Germany | 68/145 |
| 147858 | 4/1981 | Fed. Rep. of Germany | 68/27 |
| 2381859 | 9/1978 | France . | |
| 574524 | 4/1976 | Switzerland . | |

*Primary Examiner*—Philip R. Coe

*Attorney, Agent, or Firm*—McAulay Fisher Nissen Goldberg & Kiel

[57] ABSTRACT

A scoop-up portion of scoop means is of a flat plate shape so that water is drained by letting a wash rest on the scoop portion during the transferring operation. The wash is scooped surely in raise/drop washing so that the wash is not caught between the inner peripheral surface and one edge of the scoop-up portion. Also, an auxiliary plate is installed on the back surface of transfer portion of the scoop means to prevent the wash from dropping into the preceding vessel in raise/drop washing. Thus, the crumple washing and beat washing are performed efficiently, and cleanliness is improved.

2 Claims, 27 Drawing Sheets

CONTINUOUS WASHING MACHINE

FIELD OF THE INVENTION AND RELATED ART STATEMENT

FIG. 28 shows a continuous washing machine proposed in the Japanese Utility Model Publication No. 1903/1986. With this washing machine, a wash 6 carried by a supply conveyor C is thrown into a drum 1 in a stationary first vessel through a chute or hopper H. A detergent and other additives may be thrown into the first vessel together with the wash or may be thrown into a second or any of subsequent vessels. The detergent and additives may be thrown into a vessel separately or simultaneously by installing an inlet port or a valve.

In FIG. 28, water enters the vessel through a washing water inlet port 7, flows on the bottoms of stationary vessels 2'', 2', 2 as a continuous flow in the direction opposite to the transfer direction of the wash 6, 6', 6'', and enters a contaminated water tank 16. The washing operation is performed by charging a plurality of drums 1, 1', 1'', which are connected in series to each other, with wash together with an appropriate amount of a detergent and other additives and by oscillating the drums 180° or over, preferably about 270° as shown in FIG. 30(*a*). In order to transfer the wash from the first drum 1 to the second drum 1', the drum 1 is rotated in one direction at least 270° as shown in FIG. 30(*b*).

The oscillation and rotation of the drum is performed by means of gears 9, 9', which are connected to a motor with a reducer for driving drums (a drive motor) 8, and a publicly known speed change clutch mechanism 10.

A wash is transferred from one drum to the next drum as shown in FIGS. 30(*b*) and 31 by means of a transfer scoop 4, 4', 4'' installed in the drum as shown in FIG. 29. The wash is scooped up in each drum space, passes through a flange portion 11, and is transferred to the next vessel. At this time, washing water is allowed to flow through slits 3, 3' at the outer periphery of drum between the scoop 4, 4', 4'' and an auxiliary plate 5, 5'.

The conventional continuous washing machine described above, in which a wash 6 is washed only by crumple washing performed by the oscillation of drum, has a disadvantage that a mechanical force given to the wash 6 is weak, so that heavily soiled objects cannot be washed clean in a short time.

Also, in the above-described continuous washing machine, the water level in each drum may lower during continuous washing, the wash 6 may become in an overcharging condition with respect to the drum capacity, or the bulk height of wash 6 in the drum may vary depending on the mass, shape, type, and the size of each item of wash 6. Therefore, there is a possibility that the transfer is not completed because the wash 6 sticks to the plate surface of scoop 4 or because the wash 6 is caught by the opening to the next vessel.

Additionally, in the conventional continuous washing machine, the portion where the wash 6 is scooped up with the scoop 4 is the opening to the next vessel. During oscillation, this opening faces the wash 6. Therefore, a small item of wash 6 such as a towel moves freely and independently and is caught by the opening, so that some of the wash 6 is transferred during washing. If some of the wash 6 is transferred during washing, the transferred wash is mixed with the wash in the next vessel, the capacity of one vessel being exceeded, by which the washing of wash 6 becomes insufficient, or blockage may be caused.

OBJECT AND SUMMARY OF THE INVENTION

The present invention is proposed to solve the above problems.

Accordingly, the continuous washing machine of the present invention comprises a drum having a charge port for a wash at one end and a discharge port for a wash at the other end, partition plates which have an opening at the center and divide the inside of the drum into a plurality of vessels, and a scoop means which scoops up the wash along with the rotation of the drum and sequentially transfers the wash through the openings from a vessel on the charge port side to a vessel on the discharge port side, in which the scoop means comprises a scoop-up portion which is a flat plate installed in parallel to the axis of said drum and whose edge portion extends to the inner peripheral surface of the drum and a transfer portion which is connected to the other edge of the scoop-up portion and whose edge is connected to the opening edge of the next vessel.

In this embodiment of the continuous washing machine, the scoop-up portion of the scoop means is of a flat plate shape, so that the wash being transferred, after being scooped up, rests on the scoop-up portion until the scoop-up portion reaches a certain inclination angle, during which the drain-off of water is performed, and also the wash being raise/drop washed is surely scooped up.

Also, the continuous washing machine of the present invention comprises a drum having a charge port for a wash at one end and a discharge port for a wash at the other end, partition plates which have an opening at the center and divide the inside of the drum into a plurality of vessels, and a scoop means which scoops up the wash along with the rotation of the drum and sequentially transfers the wash through the openings from a vessel on the charge port side to a vessel on the discharge port side, in which the scoop means comprises a scoop-up portion which is a flat plate installed in parallel to the axis of said drum and whose edge portion extends to the inner peripheral surface of the drum and a transfer portion which is connected to the other edge of the scoop-up portion and whose edge is connected to the opening edge of the next vessel, and an auxiliary plate is installed on the back surface of the transfer portion so as to be substantially flush with the scoop-up portion.

In this embodiment of the continuous washing machine, since the auxiliary plate is provided, the wash being raise/drop washed will not drop into the opening of the preceding vessel side. As a result, crumple washing and beat washing are performed efficiently, and the cleanliness can be improved.

Further, the continuous washing machine of the present invention comprises a drum having a charge port for a wash at one end and a discharge port for a wash at the other end, partition plates which have an opening at the center and divide the inside of the drum into a plurality of vessels, and a scoop means which scoops up the wash along with the rotation of the drum and sequentially transfers the wash through the openings from a vessel on the charge port side to a vessel on the discharge port side, in which the scoop means comprises a scoop-up portion which is a flat plate installed in parallel to the axis of said drum and whose edge portion extends to the inner peripheral surface of the drum and a transfer portion which is connected to the other edge of the scoop-up portion and whose edge is connected to the opening edge of the next vessel, and one edge of the scoop-up portion forms a bent portion at right angles to the inner peripheral surface of the drum.

In this embodiment of the continuous washing machine, since one edge of the scoop-up portion is at right angles to the inner peripheral surface of the drum, the wash being raise/drop washed is not caught between the inner peripheral surface of the drum and the scoop-up portion.

Further, the continuous washing machine of the present invention comprises a drum having a charge port for a wash at one end and a discharge port for a wash at the other end, partition plates which have an opening at the center and divide the inside of the drum into a plurality of vessels, and a scoop means which scoops up the wash along with the rotation of the drum and sequentially transfers the wash through the openings from a vessel on the charge port side to a vessel on the discharge port side, in which the scoop means comprises a scoop-up portion which is a flat plate installed in parallel to the axis of said drum and whose edge portion extends to the inner peripheral surface of the drum and a transfer portion which is connected to the other edge of the scoop-up portion and whose edge is connected to the opening edge of the next vessel, an auxiliary plate is installed on the back surface of the transfer portion so as to be substantially flush with the scoop-up portion, and one edge of the scoop-up portion forms a bent portion at right angles to the inner peripheral surface of the drum.

In this embodiment of the continuous washing machine, crumple washing and beat washing can be performed efficiently, and water is drained sufficiently when the wash is transferred to the next vessel.

Further, the continuous washing machine of the present invention comprises a drum having a charge port for a wash at one end and a discharge port for a wash at the other end, partition plates which have an opening at the center and divide the inside of the drum into a plurality of vessels, and a scoop means which scoops up the wash along with the rotation of the drum and sequentially transfers the wash through the openings from a vessel on the charge port side to a vessel on the discharge port side, in which the scoop means includes a detecting means for detecting the presence of a wash.

In this embodiment of the continuous washing machine, the incomplete transfer of the wash can be detected by the detecting means during transferring. Therefore, incomplete transfer of the wash can be avoided on the basis of the result of detection, by which the incompleteness of transfer can be eliminated.

Further, the continuous washing machine of the present invention comprises a drum having a charge port for a wash at one end and a discharge port for a wash at the other end, partition plates which have an opening at the center and divide the inside of the drum into a plurality of vessels, and a scoop means which scoops up the wash along with the rotation of the drum and sequentially transfers the wash through the openings from a vessel on the charge port side to a vessel on the discharge port side, in which a fresh water supply means is installed to spray fresh water to the scoop means during the transferring operation.

In this embodiment of the continuous washing machine, by supplying fresh water from the fresh water supply means to the scoop means during transferring, the wash is soaked with fresh water, resulting in the increase in weight and the decrease in bulk. Also, fresh water flows on the surface of scoop means. Therefore, the wash slips smoothly.

Further, the continuous washing machine of the present invention comprises a drum having a charge port for a wash at one end and a discharge port for a wash at the other end, partition plates which have an opening at the center and divide the inside of the drum into a plurality of vessels, and a scoop means which scoops up the wash along with the rotation of the drum and sequentially transfers the wash through the openings from a vessel on the charge port side to a vessel on the discharge port side, in which the scoop means comprises a scoop-up portion which is a flat plate installed in parallel to the axis of said drum and whose edge portion extends to the inner peripheral surface of the drum and a transfer portion which is connected to the other edge of the scoop-up portion and whose edge is connected to the opening edge of the next vessel, and a cover is installed at the scoop-up portion to open/close the opening which is defined by the scoop-up portion and the transfer portion.

In this embodiment of the continuous washing machine, the cover is closed during the washing operation, so that the wash is not transferred even when the wash faces the scoop-up portion. This eliminates a possibility that the wash in the adjacent vessel is mixed and the capacity of one vessel is exceeded, and prevents insufficient washing and blockage. Since the cover begins to close when the wash is scooped, the wash can be pushed in the opening, so that the transferring operation can be performed surely.

DETAILED DESCRIPTION OF PREFERRED EMBODIMENTS

Figure 1:
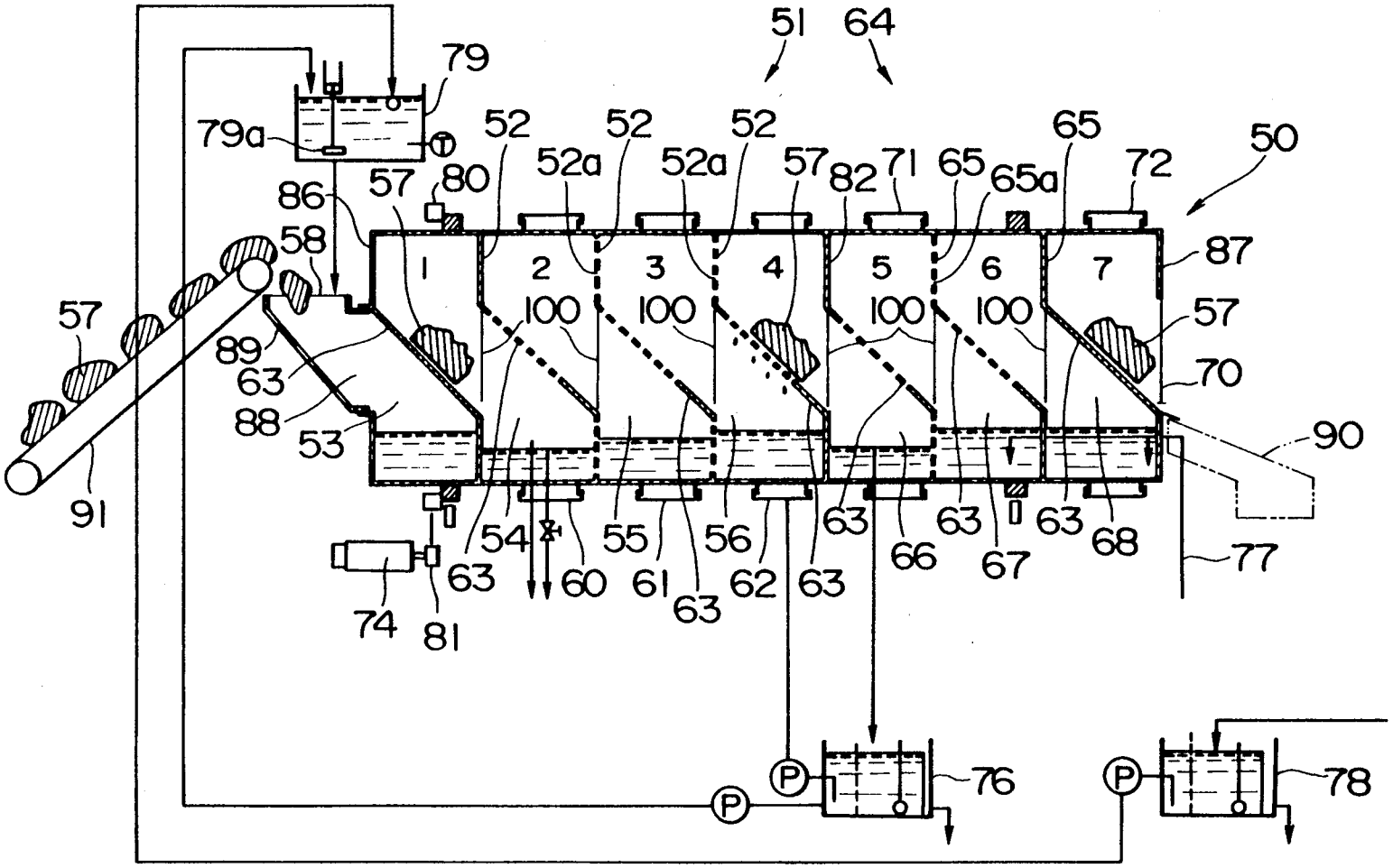
FIG. 1 is a schematic view showing the total system for a continuous washing machine in accordance with the first embodiment of the present invention, FIGS. 2(*a*)–2(*b*) are views for illustrating the motion for oscillation washing, FIGS. 3(*a*)–3(*f*) are views for illustrating the motion for raise/drop washing, FIGS. 4(*a*)–4(*e*) are views for illustrating the motion for transferring.
Figure 2A:
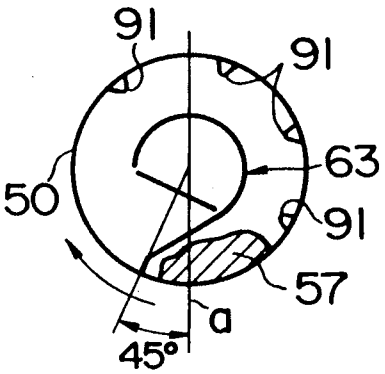
Figure 2B:
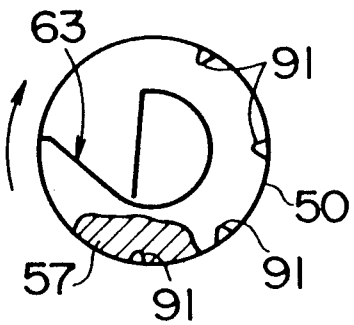
Figure 2C:
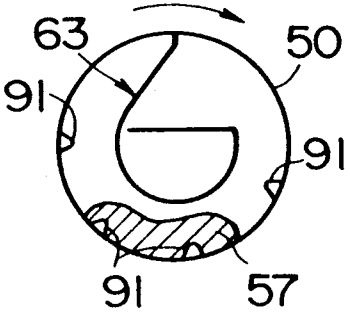
Figure 2D:
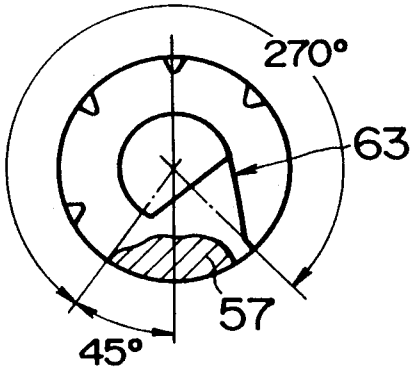
Figure 2E:
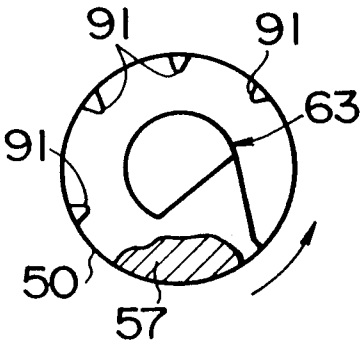
Figure 2F:
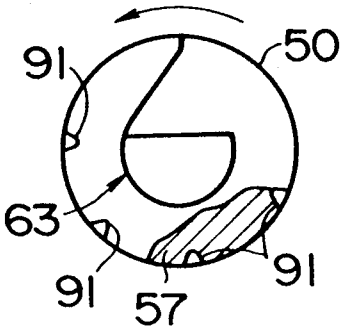
Figure 2G:
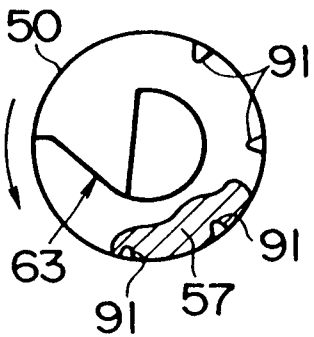
Figure 2H:
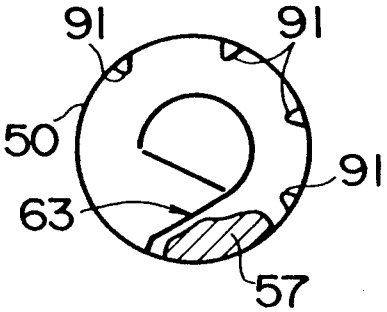
Figure 3A:
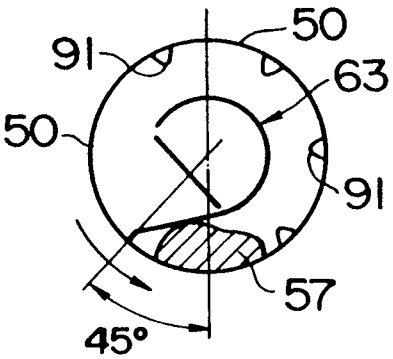
Figure 3B:
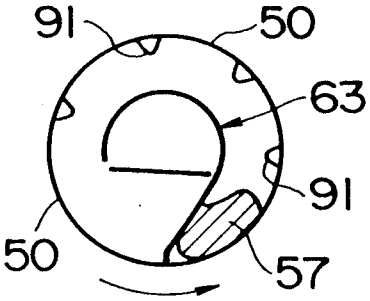
Figure 3C:
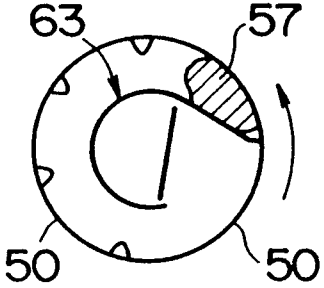
Figure 3D:
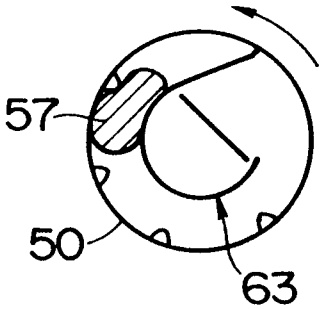
Figure 3E:
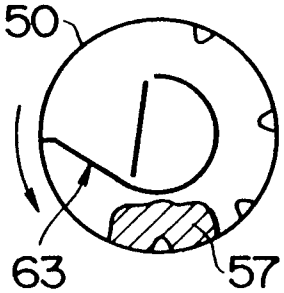
Figure 3F:
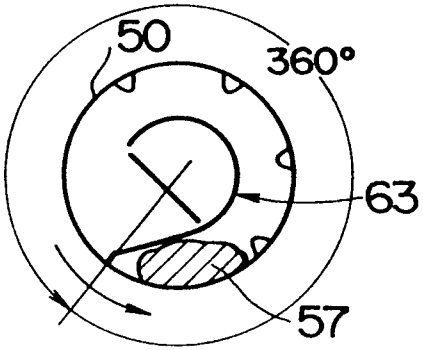
Figure 4A:
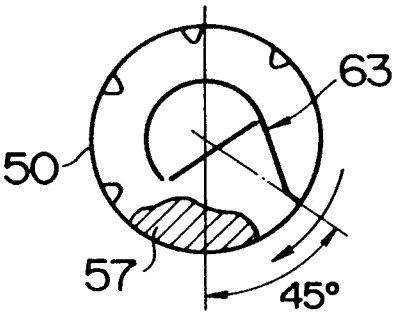
Figure 4B:
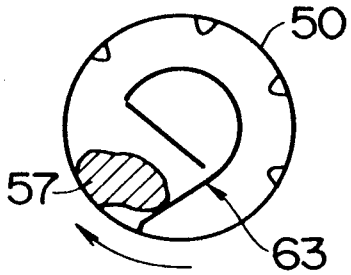
Figure 4C:
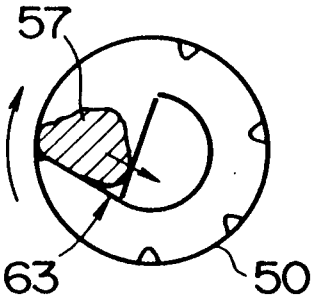
Figure 4D:
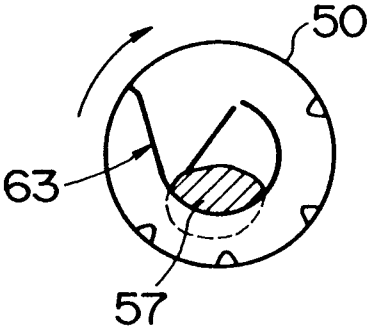
Figure 4E:
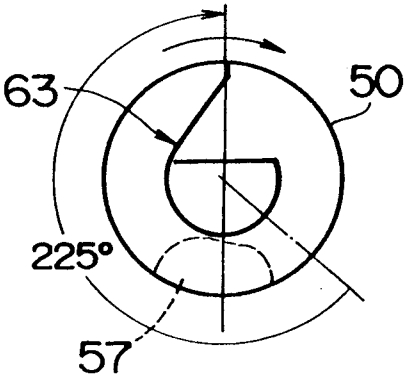
Figure 5:
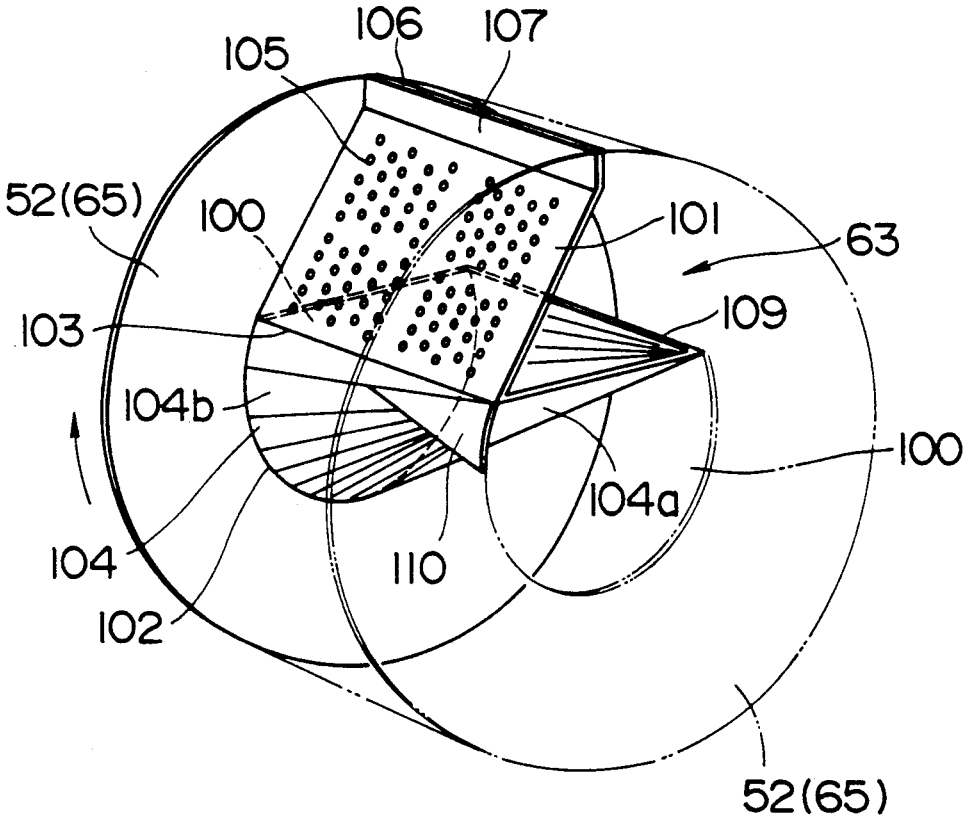
FIG. 5 is a perspective view showing the inside structure of one vessel.

As shown in FIG. 1, a drum 50 is rotatively supported by an appropriate means. At the outer periphery of the drum 50, a gear 80 is installed, with which a drive gear 81 is engaged. The drive gear 81 is connected to a motor 74 and driven by the motor 74, by which the drum is rotated.

The drum 50 is divided into a washing zone 51 and a rinsing zone 64 by a partition plate 82. The washing zone 51 is divided into four vessels 53, 54, 55, 56 by three partition plates 52 disposed at substantially equal intervals. The rinsing zone 64 is divided into three vessels 66, 67, 68 by two partition plates 65 disposed at substantially equal intervals. The partition plate has an opening 100 formed at the center. The partition plate 52 between the second vessel 54 and the third vessel 55, the partition plate 52 between the third vessel 55 and the fourth vessel 56, and the partition plate 65 between the fifth vessel 66 and the sixth vessel 67 has many holes 52*a*, 65*a* which are formed so that water flows from one vessel to the adjacent vessel. The partition plate 52 between the first vessel 53 and the second vessel 54, the partition plate 82 between the fourth vessel 56 and the fifth vessel 66, and the partition plate 65 between the sixth vessel 67 and the seventh vessel 68 have no holes so that water does not flow into the adjacent vessel.

In the drum 50, pre-washing is performed in the first vessel 53, washing is performed in the second vessel 54, the third vessel 55 and the fourth vessel 56, and rinsing is performed in the fifth vessel 66, the sixth vessel 67, and the seventh vessel 68.

The end plates 86, 87 of the drum have an opening 88, 70 formed at the center. A charge chute 89 for a wash 57 is installed at the opening 88, and a discharge chute 90 for a wash 57 is installed at the opening 70. At the opening 58 of the charge chute 89, a supply conveyor 91 for a wash 57 is disposed.

A scoop means 63 is installed in each of the vessels 53, 54, 55, 56, 66, 67, 68.

The drum 50 is driven by the motor 74. It performs crumple washing (and crumple rinsing) by oscillating a wash in the vessel, and performs raise/drop washing (and raise/drop rinsing) by rotating in one direction and transfers the wash to the next vessel by rotating in the other direction.

The oscillation for crumple washing is performed by oscillating the tip of scoop means 63 in the range from the position of about 45° clockwise with respect to the vertical line to a position advancing about 270° clockwise as shown in FIG. 2(*a*)-(*h*). When the drum 50 is oscillated in this range, the wash in the vessel is crumpled by beaters 91 installed on the inner peripheral surface of drum, by which crumple washing is performed.

The rotation for raise/drop washing is performed by rotating the tip of scoop means 63 about 360° counterclockwise from the position of about 45° clockwise with respect to the vertical line as shown in FIG. 3(*a*)-(*f*). In this process, a wash 57 is raised by the scoop means 63 (FIG. 3(*b*), (*c*)) and leaves the scoop means 63 and drops when the wash reaches a position advancing about 270° from the initial position (FIG. 3(*d*)). The wash 57 is thrown onto the bottom of vessel, by which beat washing is performed.

The above two washing operations are combined appropriately depending on the type and soiled condition of a wash 57.

The rotation for transferring the wash to the next vessel is performed by rotating the tip of scoop means 63 about 225° clockwise from the position of about 45° counterclockwise with respect to the vertical line as shown in FIG. 4(*a*)-(*e*). In this process, a wash 57 is scooped up by the scoop means (FIG. 4(*b*)). As the scoop means moves upward, the wash 57 on the scoop means 63 is guided by the scoop means 63 (FIG. 4(*c*)), and moved to the opening of vessel (FIG. 4(*d*)). The above-described rotation angle of scoop 63 is an example.

In FIG. 1, reference numerals 60, 61, 62, 71, 72 denote stationary drums disposed at the outer periphery of the drum 50. These stationary drums 60, 61, 62, 71, 72 are disposed in correspondence to the vessels 54, 55, 56, 66, 68, respectively. In these stationary drums, supply and discharge of washing water, input of detergent, and heating are performed.

A water supply tank 79 supplies water to a wash thrown into the charge chute 89 to wet the wash so that the wash slips easily. A recycle tank 76 contains rinsing water discharged from the stationary drum 71. The water contained in the recycle tank 76 is sent to the water supply tank 79 and the stationary drum 62. A recovery tank 78 recovers the water from a not illustrated dehydrator and sends the water to the water supply tank 79.

The scoop means 63 disposed in the above-mentioned vessels 53, 54, 55, 56, 66, 67, 68 will be described in detail with reference to FIGS. 5 through 8.

The scoop means 63 has a scoop-up portion 101 for scooping up a wash 57 and a transfer portion 104 for transferring the scooped wash to the next vessel.

The scoop-up portion 101 is of a flat plate shape and is disposed in parallel to the axis of the drum 50. Among the scoop means in the vessels 53, 54, 55, 56, 66, 67, 68, the scoop-up portion of the second vessel 54, the third vessel 55, the fourth vessel 56, the fifth vessel 66, and the sixth vessel 67 has many holes 105 throughout the plate as shown in the figure.

With this scoop means 63, a wash 57 is scooped up by the scoop-up portion 101, and rests on the scoop-up portion 101 until the scoop-up portion 101 reaches a certain inclination angle, during which the drain-off of water is performed to prevent the contaminated water from being sent to the next vessel. The scoop means 63 in the first vessel 53 and the seventh vessel 68 which do not require drain-off of water have no holes at the scoop-up portion 101.

One end of the scoop-up portion 101 is bent toward the inner peripheral surface of drum. This bent portion 107 consists of a plane including the axis of drum 50 and is perpendicular to the inner peripheral surface of drum 50. The height h of the bent portion 107 is nearly equal to 0.05D (D is the diameter of the drum 50). If h is too small, the gap between the scoop-up portion 101 and the drum 50 at their intersection becomes small. As a result, when a wash 57 is raised (FIG. 3(*b*), (*c*)) in raise/drop washing shown in FIG. 3, the wash 57 may be caught by the gap between the scoop-up portion 101 and the drum 50, so that the wash 57 sometimes does not drop even when the scoop means 63 reaches the position of FIG. 3(*d*). If h is too large, the movement of wash 57 is disturbed by the bent portion 107, so that the wash 57 sometimes does not move onto the scoop-up portion 101, when the wash 57 is scooped up (FIG. 4(*b*)) in the transferring operation shown in FIG. 4.

The transfer portion 104 guides the wash 57, which moves toward the center of drum 50 on the scoop-up portion 101, to the opening 100 formed at the end of drum 50 while changing the direction. It consists of a curved portion 104*b* and a flat portion 104*a*.

Figure 6:
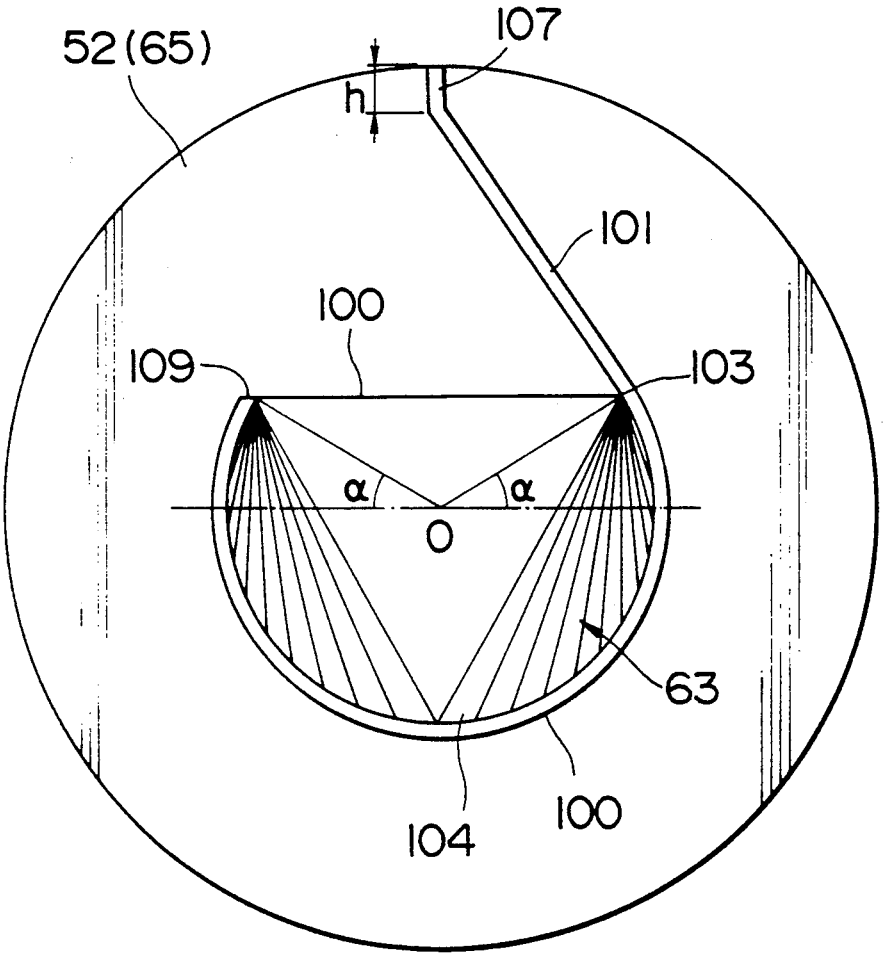
FIG. 6 is a front view of a scoop means.
Figure 7:
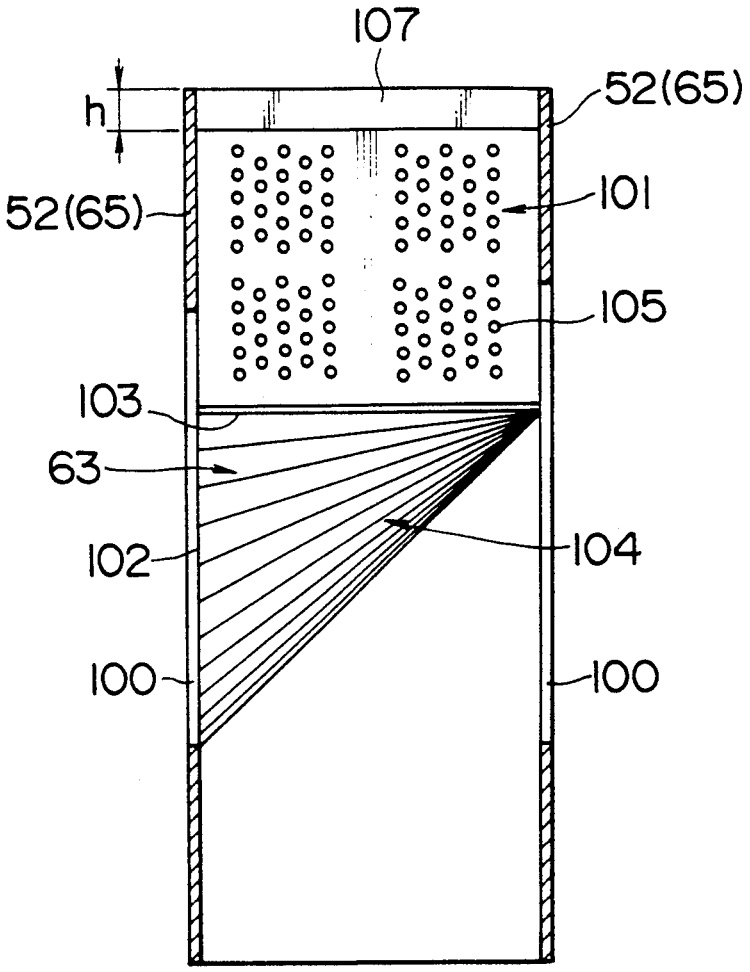
FIG. 7 is a side view of a scoop means.
Figure 8:
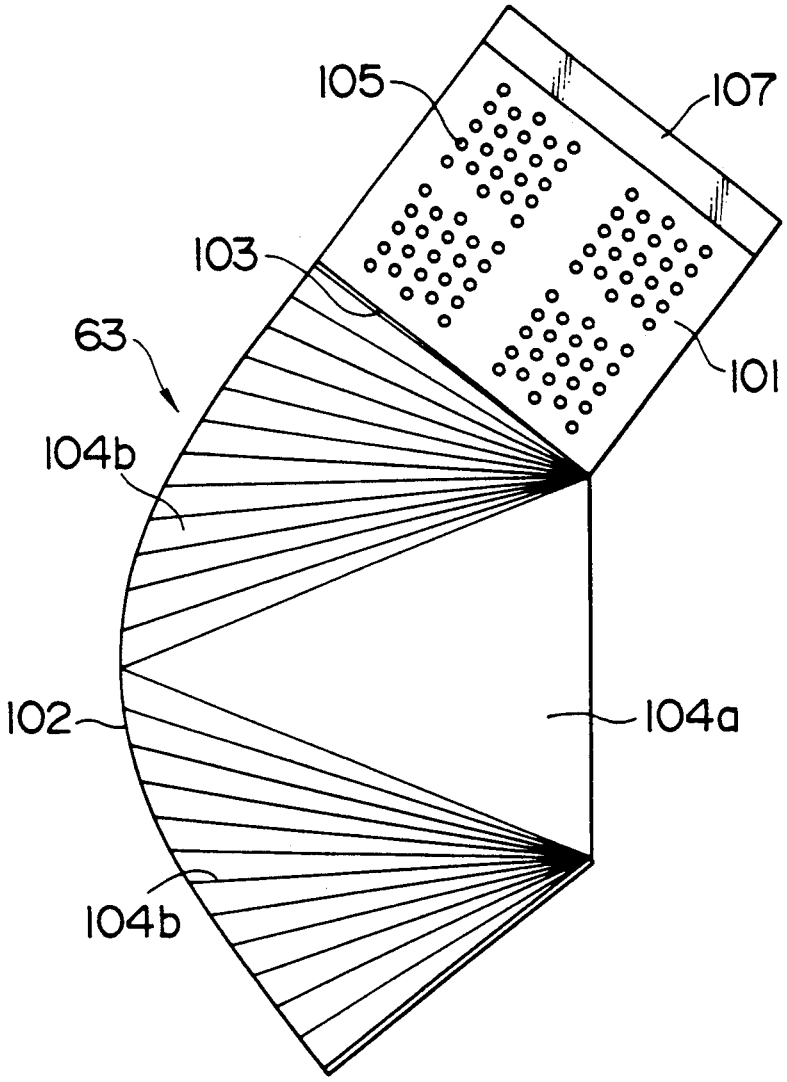
FIG. 8 is a expanded plan view of a scoop means.

As shown in FIG. 8, the flat portion 104*a* is of a triangular form, and the curved portion 104*b* is disposed so as to surround two sides of the flat portion 104*a*. The edge 102 of the curved portion 104*b* is connected to the edge of the opening 100 of the drum 50, and one side 103 of the curved portion 104*b* is connected to the base end of the scoop-up portion 101. The diameter d of an approximately semicircular portion formed by the edge 102 of the curved portion 104*b* is set so that $d/D=0.5$. The positions of one side edge 103 and the other side edge 109 are located 30° upward from the axis of the drum 50 as shown in FIG. 6 ($\alpha=30°$).

The scoop means 63 has an auxiliary plate 110 which is flush with the surface opposite to the scoop-up surface (the surface with which a wash 57 is brought into contact in raise/drop washing shown in FIG. 3) of the scoop-up portion 101 and disposed continuously to the scoop-up portion 101. This auxiliary plate 110 prevents a wash 57 from being brought back to the preceding vessel in the condition of FIG. 3(*d*) in the raise/drop washing operation shown in FIG. 3.

With the above-described scoop means, since the scoop-up portion 101 consists of a flat plate, when a wash 57 is transferred to the next vessel, the wash 57 rests on the scoop-up portion 101 until the scoop-up portion 101 becomes at a certain inclination angle after the wash 57 is scooped up. That is to say, the wash rests on the scoop-up portion 101 for a slightly longer time. However, the drain-off of water of the wash can be surely performed because many holes 105 are formed at the scoop-up portion 101. Therefore, the contaminated water is prevented from being sent to the next vessel.

Since the bent portion 107 is disposed, there is no possibility of the wash 57 being caught between the scoop-up portion 101 and the inner peripheral surface of drum 50 in raise/drop washing. Therefore, the wash 57 drops surely from the scoop-up portion 101, by which sufficient washing can be performed.

In addition, since the auxiliary plate 110 is provided, the wash 57 is not brought back to the preceding vessel.

Figure 9:
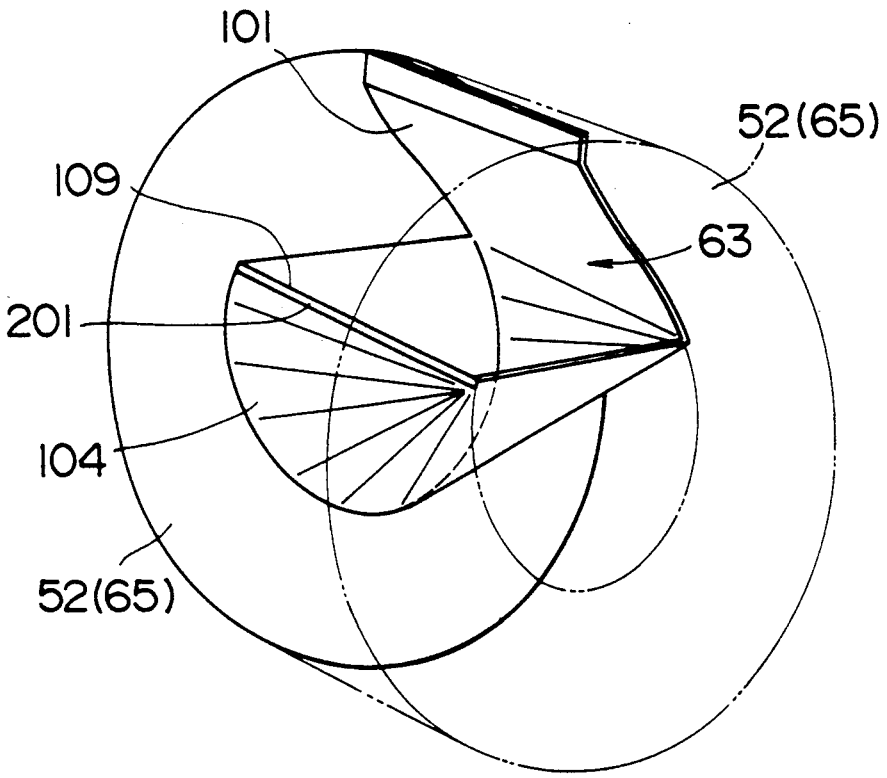
FIG. 9 is a perspective view showing the inside structure of one vessel of the second embodiment of a continuous washing machine in accordance with the present invention.
Figure 10:
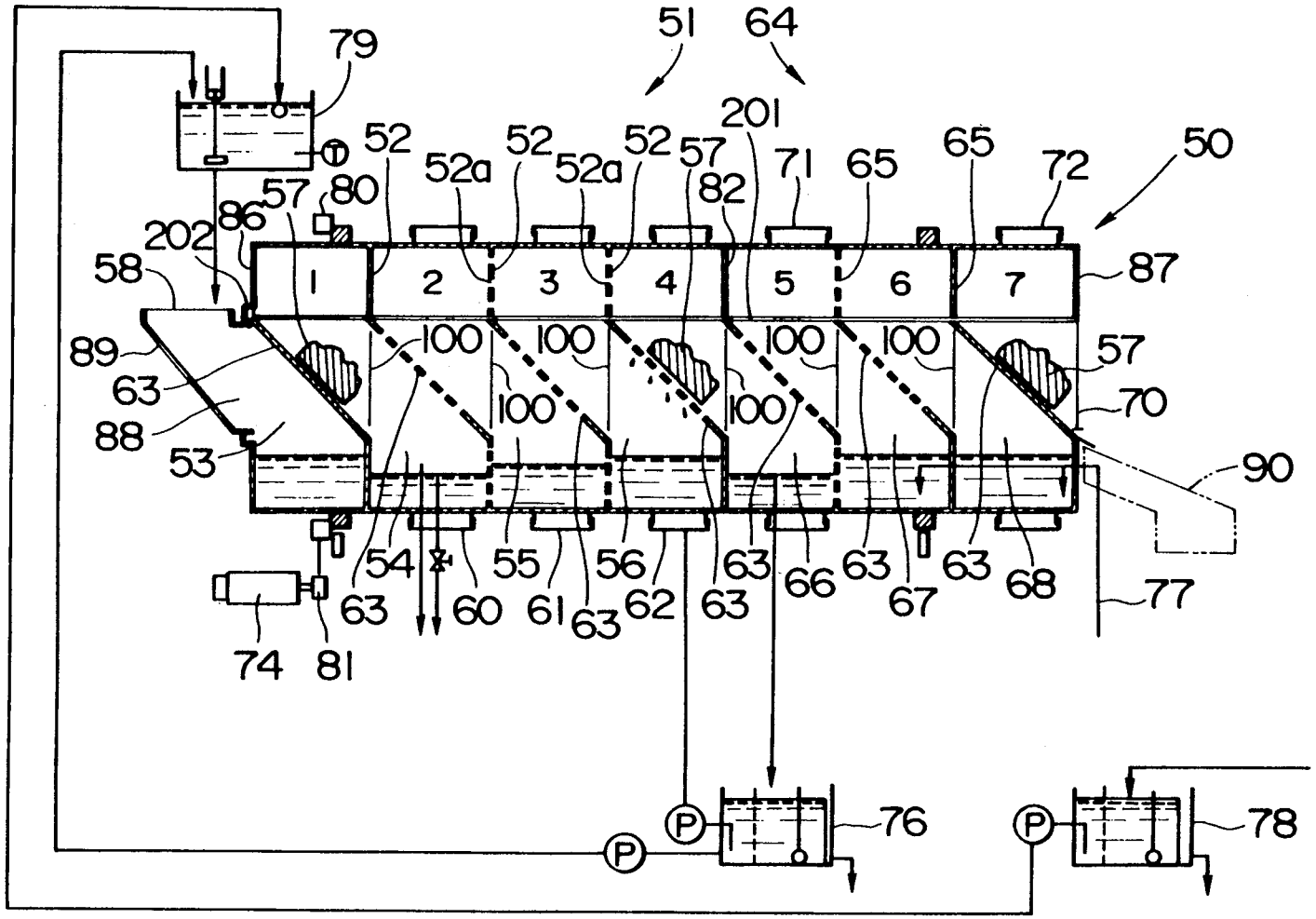
FIG. 10 is a schematic view showing the total system for a continuous washing machine, FIGS. 11(*a*)–11(*d*) are views for illustrating the motion of a drum in transferring, FIGS. 12(*a*)–12(*h*) are views for illustrating the motion of a drum in the case where a wash is caught by a scoop means in transferring.

FIGS. 9 through 12 shows the second embodiment of a scoop means 63 in accordance with the present invention. This embodiment of a scoop means 63 has a piezoelectric device 201 as a detecting means at the side edge 109 of the transfer portion 104 as shown in FIGS. 9 and 10. In this scoop means 63, therefore, the piezoelectric device 201 for the wash 57 is installed over the total length of drum 50 as shown in FIG. 10, and is electrically connected to an oscillating contact 202 which is installed in opposition to the end plate 86 of the tank 50. When a wash 57 is caught by the side edge 109 during transferring, the piezoelectric device 201 detects the presence of the wash 57 on the scoop means 63.

The motion of the continuous washing machine of the above-described construction will be described with reference to FIGS. 11 and 12.

Figures 11A, 11B, 11C, 11D:
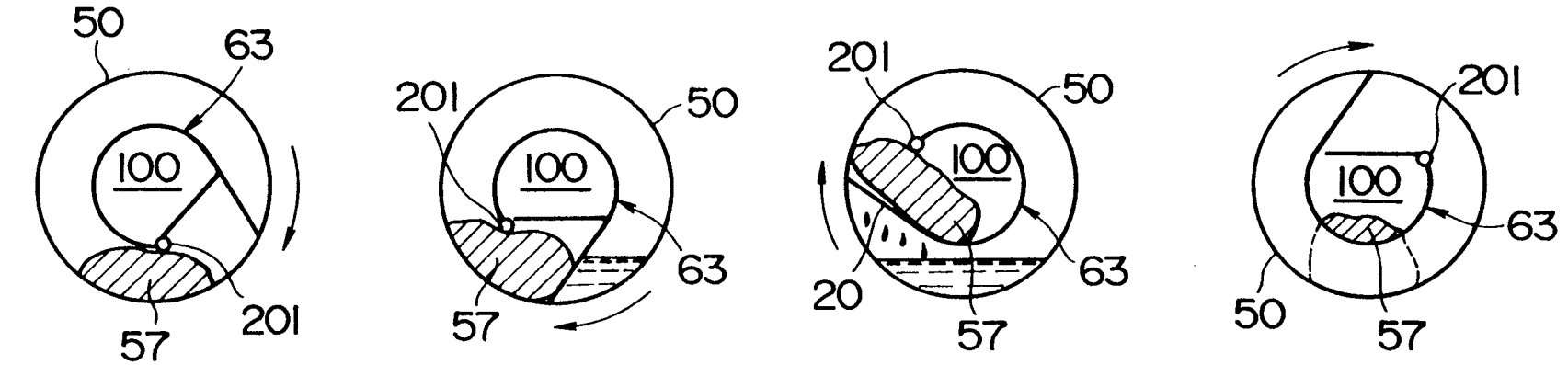
Figure 12A:
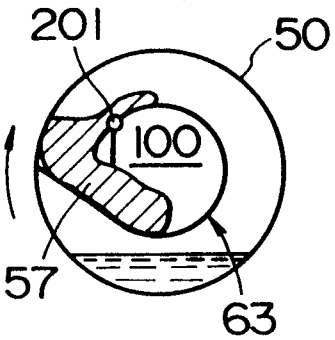
Figure 12B:
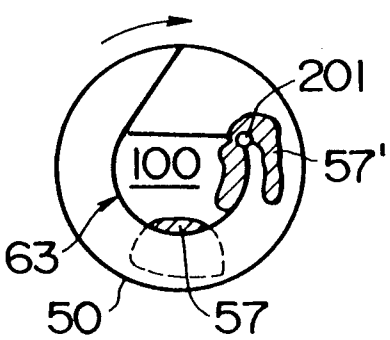
Figure 12C:
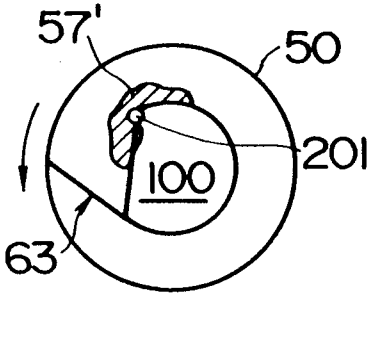
Figure 12D:
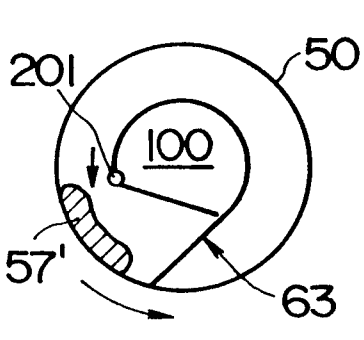
Figure 12E:
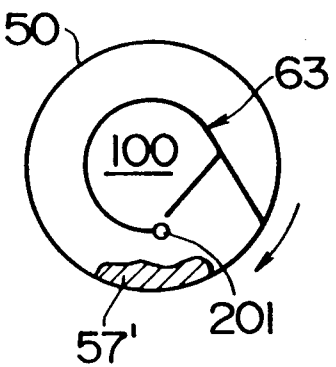
Figure 12F:
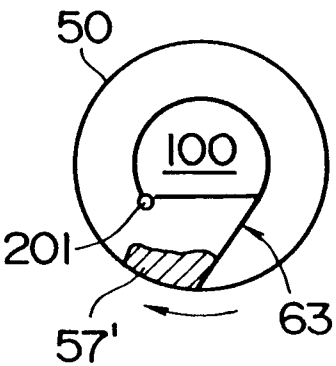
Figure 12G:
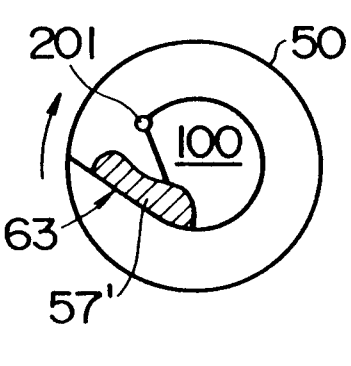
Figure 12H:
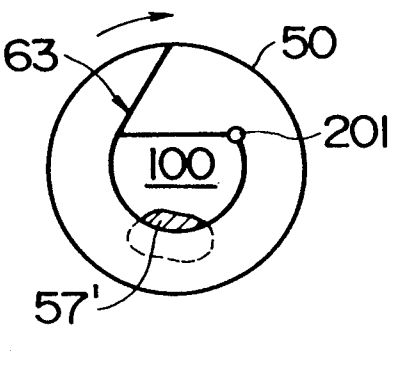

When the drum 50 is rotated clockwise from the condition of FIG. 11(*a*) to the condition of FIG. 11(*c*), a wash 57 is scooped up by the scoop-up portion 101 of the scoop means 63, and is transferred to the next vessel in the condition of FIG. 11(*d*). If all of the wash 57 is transferred properly, the piezoelectric device 201 detects nothing; normal transfer (no wash 57 remains on the scoop means 63) is confirmed.

When the drum 50 is rotated with a wash 57 being caught by the side edge 109 of the scoop means 63 as shown in FIG. 12(*a*) and some of the wash 57' remains on the scoop means 63 in the transfer completion condition as shown in FIG. 12(*b*), the piezoelectric device 201 detects the pressure of the wash 57, by which it is detected that the wash 57' remains on the scoop means 63.

When the piezoelectric device 201 detects the wash 57' caught by the side edge 109, the drum 50 is rotated in the reverse direction from the position of FIG. 12(*b*) to the position of FIG. 12(*e*) via the conditions of FIG. 12(*c*) and (*d*), so that the wash 57' caught by the side edge 109 of the scoop means 63 drops onto the inner peripheral surface of the drum 50. Then, the drum 50 is rotated again in the normal direction from the position of FIG. 12(*e*) to transfer the wash 57' to the next vessel. The drum 50 is rotated in the normal and reverse directions repeatedly until the piezoelectric device 201 does not detect the wash 57', by which the transfer motion is completed without the wash 57' caught by the side edge 109.

In the above-described continuous washing machine, when a wash 57 is caught by the side edge 109 of the scoop means 63 during the transferring operation, the piezoelectric device 201 detects the remaining wash 57. If the remaining wash 57 is detected, the drum is rotated in the reverse and normal directions repeatedly, by which the wash 57 can be fully transferred without being caught by the side edge.

Figure 13:
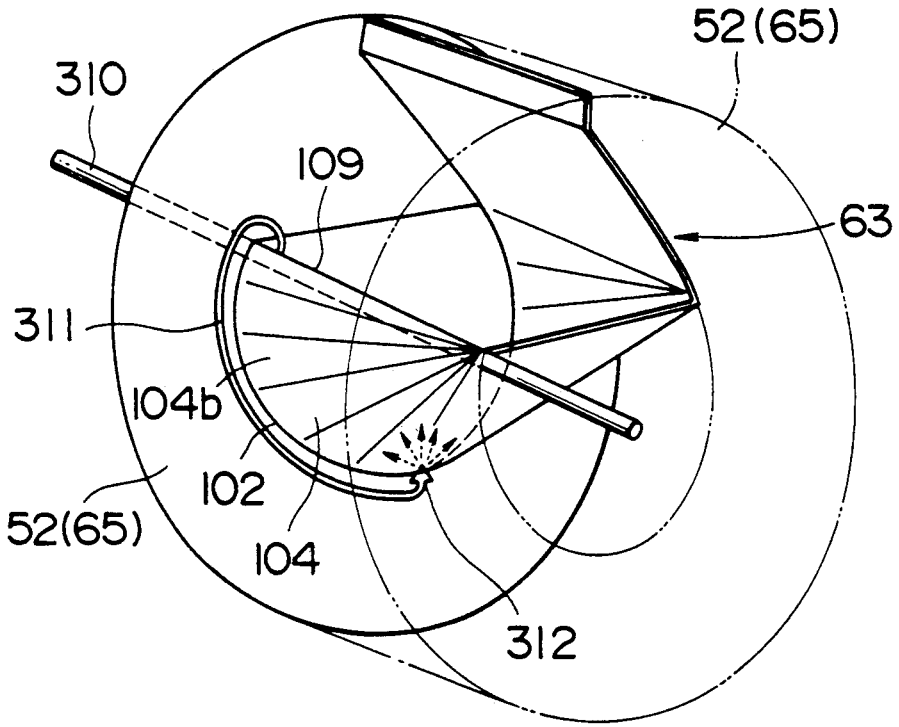
FIG. 13 is a perspective view showing the inside structure of one vessel of the third embodiment of a continuous washing machine in accordance with the present invention.
Figure 14:
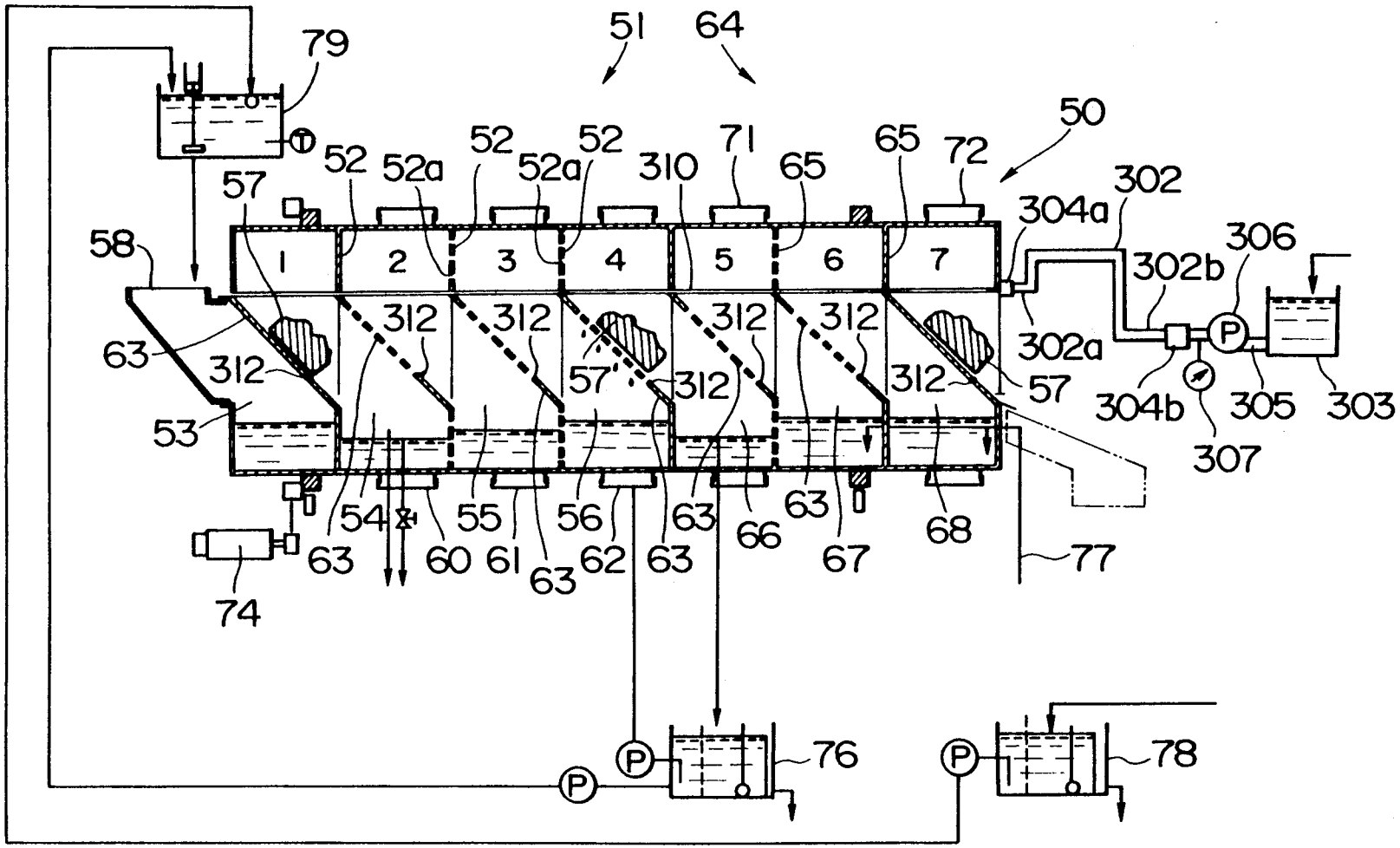
FIG. 14 is a schematic view showing the total system for a continuous washing machine, FIGS. 15(*a*)–15(*e*) are views illustrating the motion of a drum in transferring.
Figure 15A:
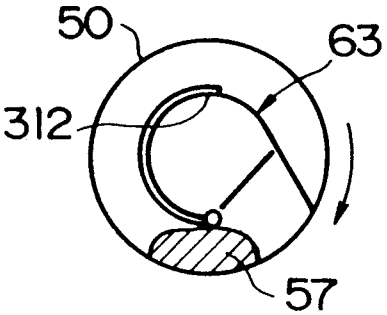
Figure 15B:
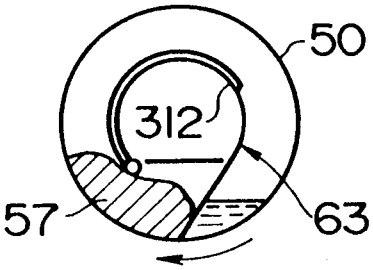
Figure 15C:
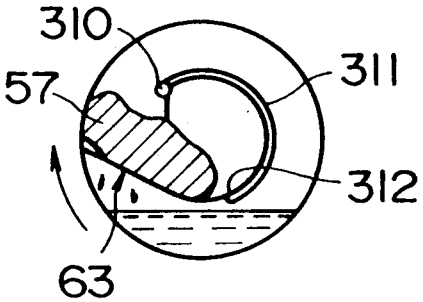
Figure 15D:
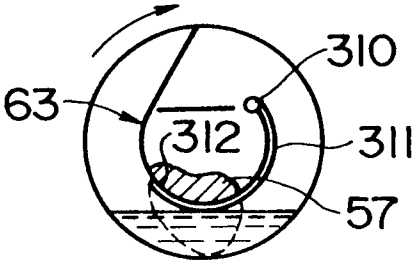
Figure 15E:
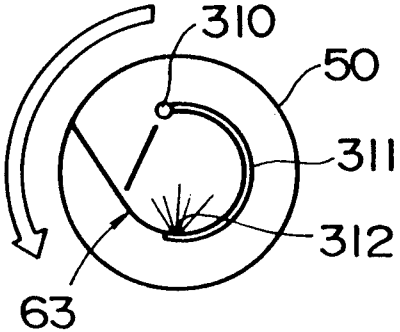

FIGS. 13 and 14 show the third embodiment of the present invention. The scoop means 63 of this embodiment has a water supply pipe 310 installed at the side edge 109 of the transfer portion 104. This water supply pipe 310 is installed throughout the drum 50 as shown in FIG. 14. The water supply pipe 310 is connected to a fresh water tank 303 via a L-shaped bent pipe 302. One end 302*a* of the bent pipe 302 is connected to the water supply pipe 310 via a first rotary joint 304*a*. The other end 302*b* is connected to a pipe 305 on the side of the fresh water tank 303 via a second rotary joint 304 at the position of rotation center of the drum 50. In FIG. 14, reference numeral 306 denotes a pump for sending fresh water to the water supply pipe 310 under a certain pressure, and 307 denotes a pressure gage.

As shown in FIG. 13, a branch pipe 311 is connected to the water supply pipe 310. The branch pipe 311 extends to the center of the edge 102 of the curved portion 104 along the back surface of the transfer portion 104, and has a jet 312 at the tip end. The jet 312 is open to the surface on which a wash 57 on the scoop means 63 is transferred. In this scoop means 63, when fresh water is pumped at a certain pressure from the fresh water tank 303 with a wash being placed on the jet 312 (on the transfer portion 104), the increase in jet water pressure at the jet 312 is verified by the pressure gage 307. That is to say, a detecting means is formed by the water supply pipe 310, the bent pipe 302, the pump 306, the pressure gage 307, the branch pipe 311, and the jet 312.

The transfer motion of the continuous washing machine of above-described construction will be described with reference to FIGS. 14 and 15(*a*)–(*e*).

When the drum 50 is rotated in the normal direction from the condition of FIG. 15(*a*) to the condition of FIG. 15(*d*), a wash 57 is scooped up by the scoop means 63 and transferred to the next vessel. After the transfer is completed (the condition of FIG. 15(*d*)), the drum 50 is rotated in the reverse direction to the condition of FIG. 15(*e*) for the next washing operation.

During the time when the drum 50 is rotated from the condition of FIG. 15(*d*) to the condition of FIG. 15(*e*), fresh water is sent to the water supply pipe 310 at a certain pressure by the drive of the pump 306, and is sprayed from the jet 312. When the wash 57 remains on the transfer portion 104 of the scoop means 63, the jet 312 is blocked by the wash 57, so that the jet pressure increases. Therefore, the presence of wash 57 is verified by the pressure gage 307. When the incompleteness of transfer of the wash 57 is detected by the increase in jet pressure, the drum 50 is rotated in the normal reverse directions repeatedly until the transfer of wash 57 is completed as with the second embodiment described above.

In the continuous washing machine described above, when the wash 57 remains on the scoop means 63 on the completion of transfer, the increase in jet pressure at the jet 312 is detected by the pressure gage 307, so that the remaining of wash 57 can be detected. Since fresh water is sprayed to the remaining wash 57, the weight of the wash 57 increases, so that the wash easily slips down when the transfer operation is performed again.

The detecting means other than those described in the second and third embodiments may be used: An optical fiber is inserted into each vessel in the drum 50 and monitoring is performed by a charge coupled device (CCD) camera, or an observation window is disposed at a part (for example, the stop position on the completion of transfer operation) of the outer periphery of each vessel in the drum 50 to perform monitoring from the outside.

Also, another detecting means may be used: A color sensor is used, and a color which the wash 57 does not has is put on the observed portion of the scoop means 63. When any color other than that color, that is, the color of wash 57 is sensed, notice is given that the transfer of wash 57 is incomplete, and the drum 50 is rotated in the normal and reverse directions repeatedly.

In addition, a plurality of the detecting means described above can be used to detect the condition of the wash 57 from the start of transfer using the scoop means 63 to the completion of transfer. When an improper condition of the wash 57 is detected at the start of transfer, the incompleteness can be avoided beforehand. When the condition of the wash 57 is detected on the completion of transfer, it can be found whether the wash has been transferred completely. When the condition of the wash 57 is detected from the start of transfer to the completion of transfer, the blockage caused by the wash 57 during transfer can be found.

The continuous washing machine of the present invention has a detecting means for detecting the presence of a wash. Since the detecting means detects the condition of wash during transferring operation, the incompleteness of transfer can be detected. Therefore, the incomplete transfer of wash can be avoided on the basis of the detection result, by which the incompleteness of transfer can be eliminated.

Figure 16:
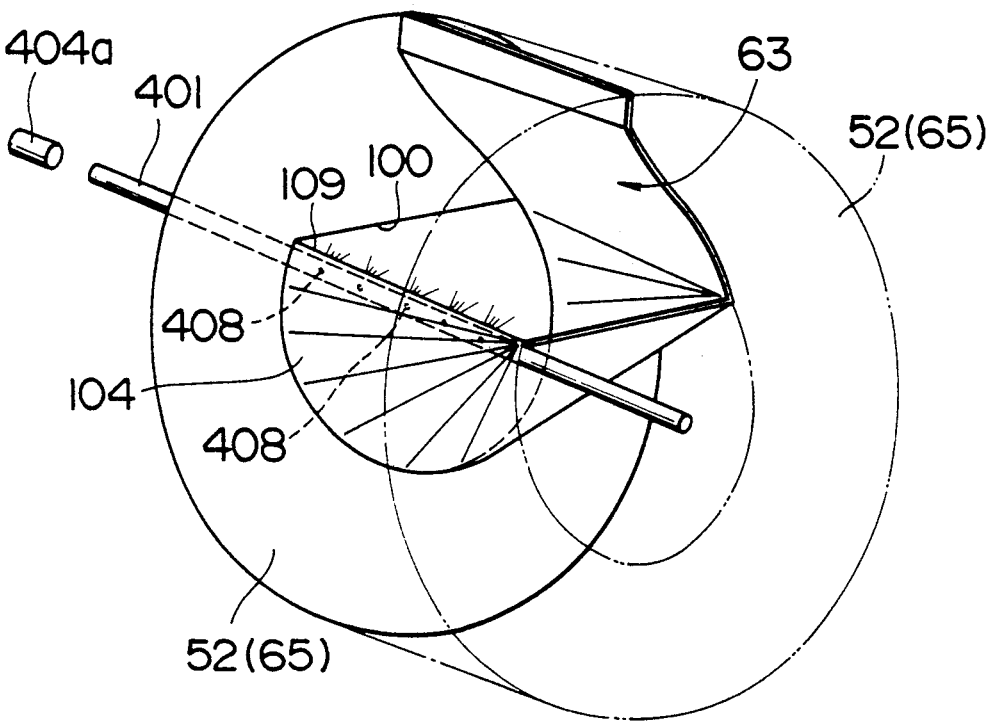
FIG. 16 is a perspective view showing the inside structure of one vessel of the fourth embodiment of a continuous washing machine in accordance with the present invention.
Figure 17:
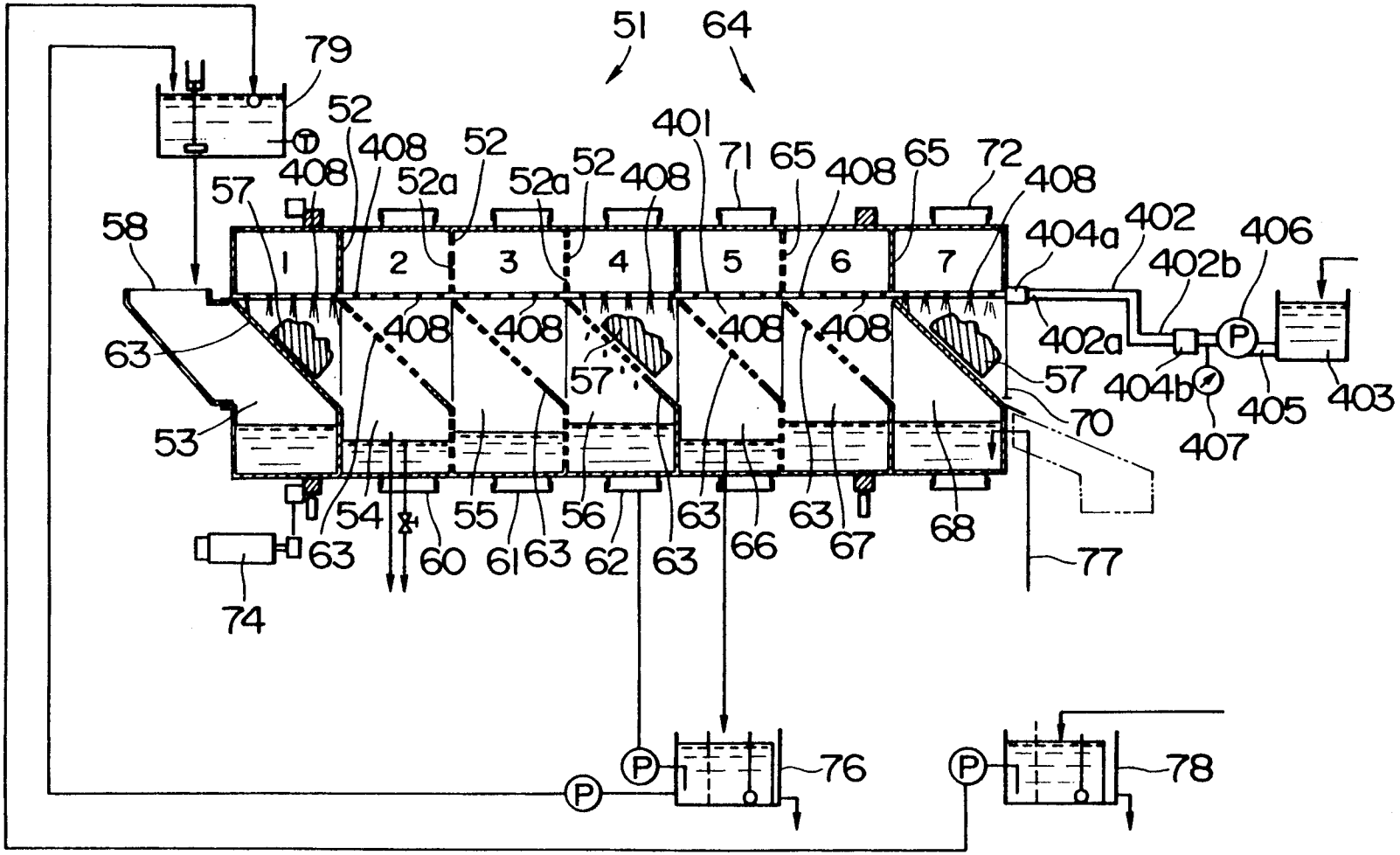
FIG. 17 is a schematic view showing the total system for a continuous washing machine, FIGS. 18(*a*)-18(*e*) are views for illustrating the motion for transferring.
Figure 18A:
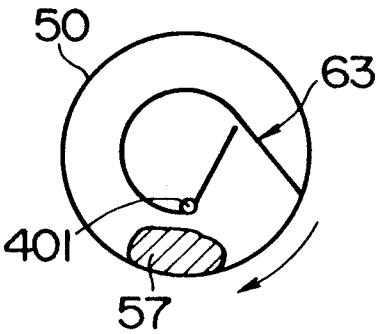
Figure 18B:
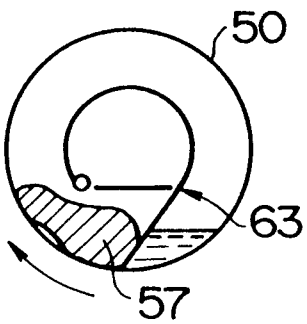
Figure 18C:
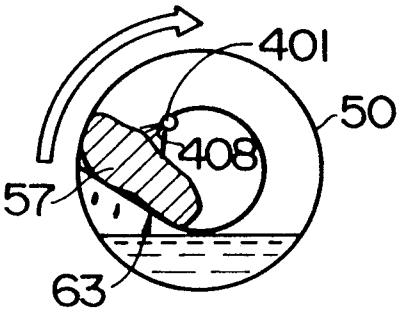
Figure 18D:
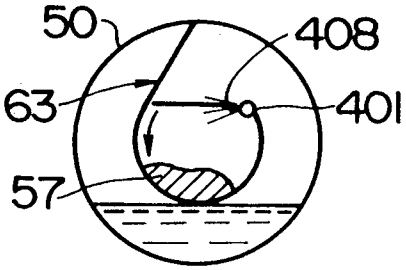
Figure 18E:
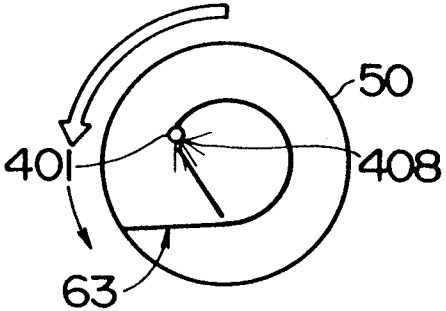

FIGS. 16 and 17 show the fourth embodiment of the present invention. In the scoop means 63 of this embodiment, a water supply pipe 401 is installed throughout the drum 50 as shown in FIG. 17. The water supply pipe 401 is connected to a fresh water tank 403 via a L-shaped bent pipe 402. One end 402*a* of the bent pipe 402 is connected to the water supply pipe 401 via a first rotary joint 404*a*. The other end 402*b* is connected to a pipe 405 on the side of the fresh water tank 403 via a second rotary joint 404 at the position of rotation center of the drum 50. In FIG. 17, reference numeral 406 denotes a pump for sending fresh water to the water supply pipe 401 under a certain pressure, and 407 denotes a pressure gage.

The water supply pipe 401 is arranged along the side edge 109 of the transfer portion of scoop means 63 as shown in FIG. 16, and has a plurality of jets 408. Fresh water in the fresh water tank 403 is sent to the water supply pipe 401 by the drive of the pump 406, and sprayed at a high pressure from the jets 408 toward the transfer portion of scoop means 63. That is to say, a fresh water supply means is formed by the fresh water tank 403, the bent pipe 402, the first rotary joint 404*a*, the second rotary joint 404*b*, and the pump 406.

By spraying fresh water at a high pressure from the jets 408 toward the transfer portion of scoop means 63, fresh water is sprayed to a wash 57 during transferring operation. The bulk of wash 57 is decreased by the water pressure, and water is supplied sufficiently to the plate surface of scoop means 63, so that the wash 57 slips down smoothly on the plate surface of the transfer portion 104 of scoop means 63.

The transfer motion of the continuous washing machine of the above-described construction will be described with reference to FIG. 18(*a*)–(*d*).

When the drum 50 is rotated in the normal direction from the condition of FIG. 18(*a*) to the condition of FIG. 18(*c*), a wash 57 is scooped up by the scoop means 63. When the drum 50 reaches the condition of FIG. 18(*c*), the spraying of fresh water is started from the jets 408. When the drum 50 is rotated in the normal direction to the condition of FIG. 18(*d*), the wash is transferred to the next vessel. The spraying of fresh water is continued in this condition. Then, the drum 50 is rotated in the reverse direction to the condition of FIG. 18(*e*) in order to perform washing operation. Fresh water continues to be sprayed during the reverse rotation to wash away the wash 57 remaining on the scoop means 63.

In the continuous washing machine described above, since fresh water is sprayed when the wash 57 is transferred, the bulk of wash 57 is decreased by the jet pressure, and its weight is increased by containing fresh water. Also, the wash 57 becomes a condition of being pressed, so that the wash 57 easily slips on the scoop means 63. For this reason, the wash 57 can be surely transferred independently of its bulk form, type, and the size of individual item. Even when the wash 57 contains sufficient water because, for example, the machine is operated with a reduced amount of water in the machine, the wash 57 can be soaked with fresh water, which performs the transferring operation smoothly and prevents the blockage.

Figure 19:
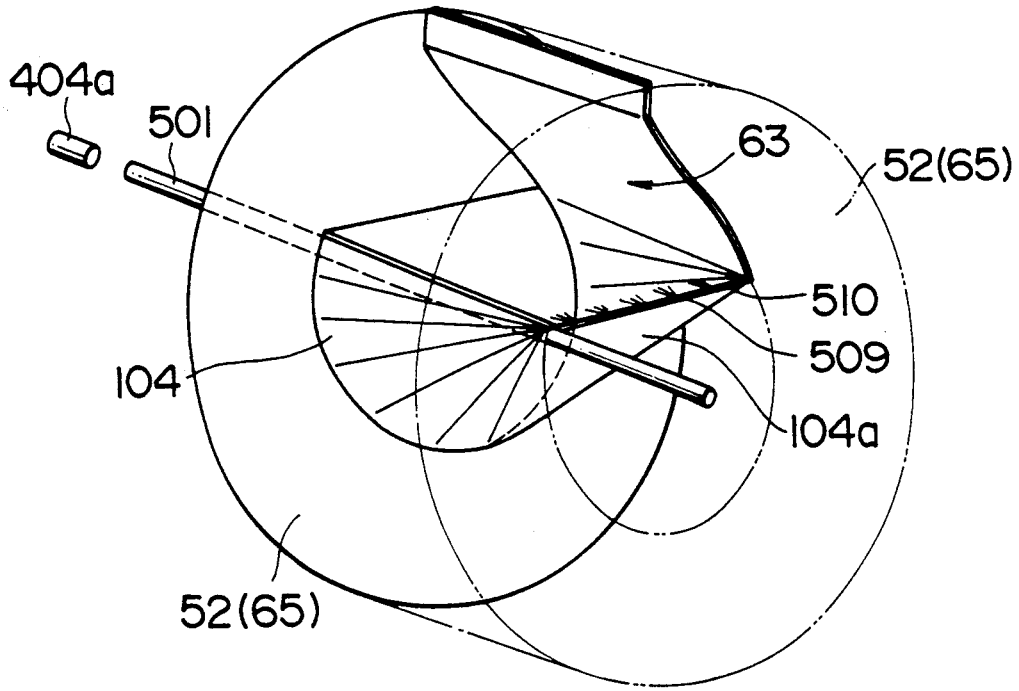
FIG. 19 is a perspective view showing the inside structure of one vessel of the fifth embodiment of a continuous washing machine in accordance with the present invention.

FIG. 19 shows a scoop means of the fifth embodiment of the continuous washing machine in accordance with the present invention. In this figure, the same reference numerals are applied to the same elements in FIGS. 1 and 2, and duplicated explanation is omitted.

In the scoop means 63 shown in FIG. 19, a water supply pipe 501 is installed along the side edge 109 of the transfer portion 104 as with the fourth embodiment described above. To this water supply pipe 501 is connected a branch pipe 510 which is installed at the upper end of inclined surface of flat portion 104*a* of the transfer portion 104. This branch pipe 510 has a plurality of jets 509. Fresh water in the fresh water tank 403 is sent to the water supply pipe 501 by the drive of the pump, 406, and sprayed at a high pressure from the jets 509 when the scoop-up portion 101 of the scoop means 63 is inclined at the maximum. Thus, water is allowed to flow on the surface of the flat portion 104*a* of the scoop means 63, so that the wash 57 slips down smoothly. Therefore, the wash 57 can be transferred surely.

In the continuous washing machine of the present invention, a fresh water supply means is installed to spray fresh water to the scoop means, and fresh water is supplied from the fresh water supply means to the scoop means during the transferring operation, by which the wash is soaked with fresh water so that the weight is increased and the bulk is decreased. At the same time, fresh water flows on the surface of the scoop means, so that the wash slips easily. As a result, the wash can be transferred surely independently of the shape, type, and size of wash, and the blockage or remaining wash can be eliminated.

Figure 20:
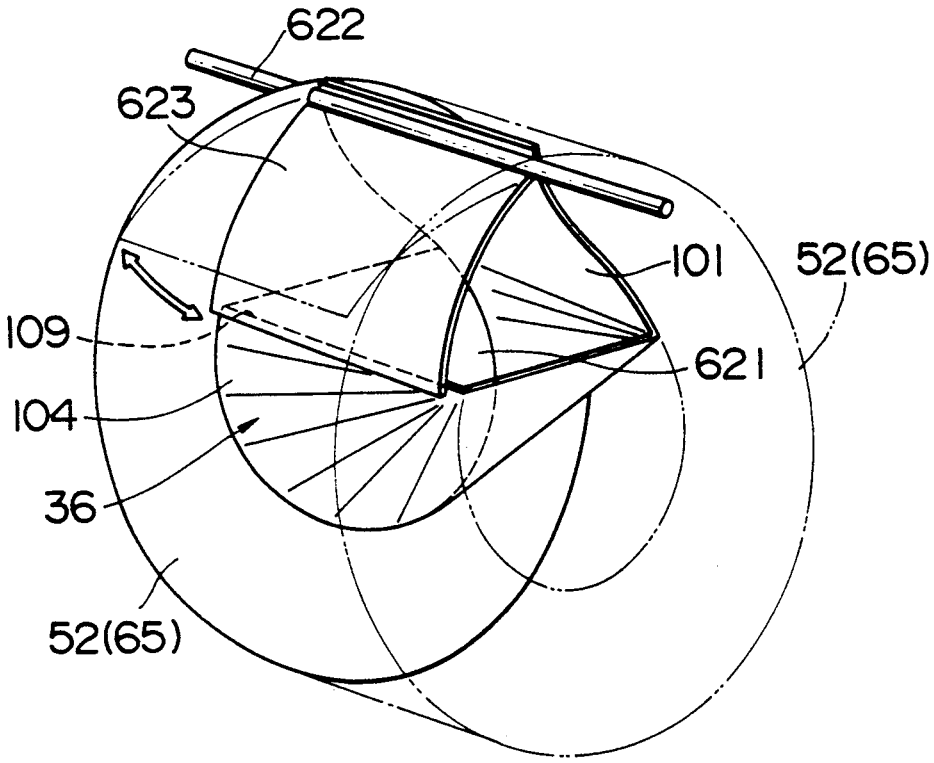
FIG. 20 is a perspective view showing the inside structure of one vessel of the sixth embodiment of a continuous washing machine in accordance with the present invention, FIGS. 21(*a*)-21(*f*) are views for illustrating the motion of a drum in oscillation washing, FIGS. 22(*a*)-22(*c*) are views for illustrating the motion of a drum in raise/drop washing, FIGS. 23(*a*)-23(*f*) are views for illustrating the motion of a drum in transferring.
Figure 21A:
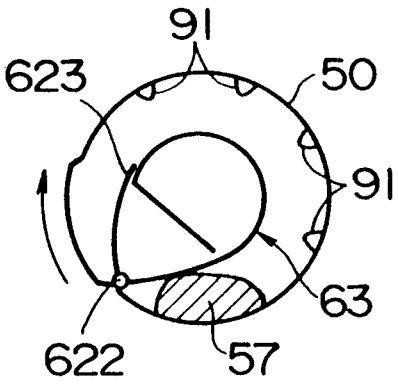
Figure 21B:
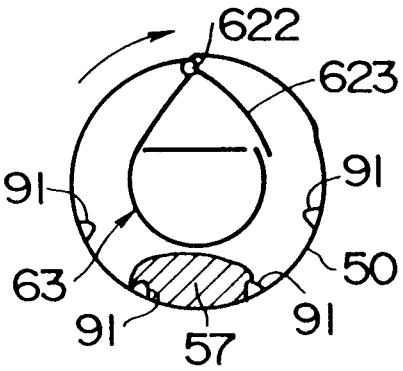
Figure 21C:
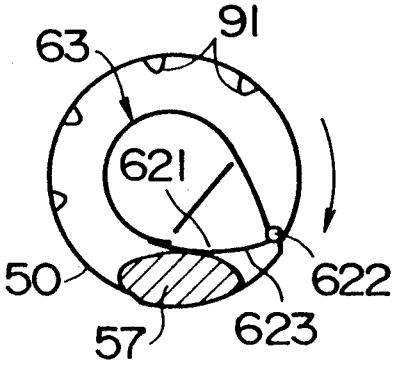
Figure 21D:
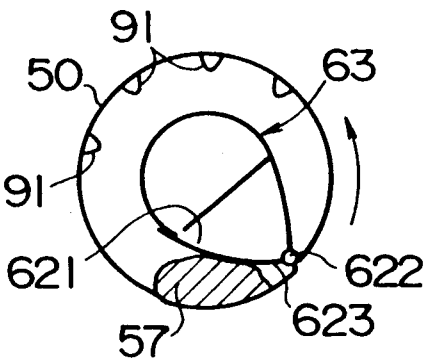
Figure 21E:
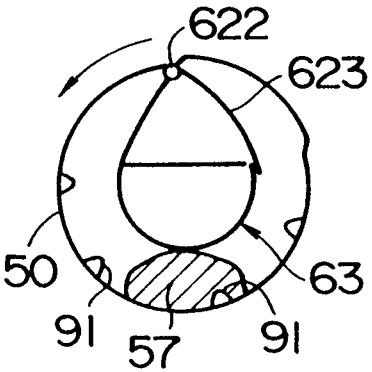
Figure 21F:
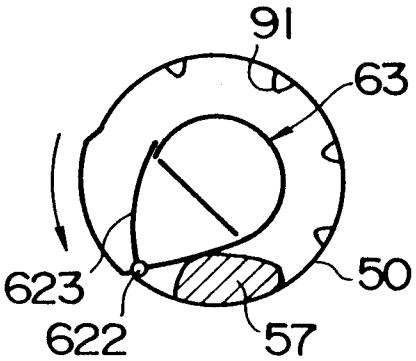

FIG. 20 shows the sixth embodiment of the scoop means in accordance with the present invention. Since the total system is the same as that of FIG. 17, the same reference numerals are applied to the same elements, and duplicated explanation is omitted.

In the scoop means 63 of this embodiment, a drive shaft 622 extending in the axial direction of drum 50 is installed at the tip end of the scoop-up portion 101. This drive shaft 622 passes through the drum 50, and driven by a not illustrated drive motor. To the drive shaft 622, one side of a cover 623 is fixed. When being closed, the cover 623 covers an opening 621 defined by the tip end of scoop-up portion 101 of the scoop means, the side edge 109 of the transfer portion 104, and the both partition plates 52 (65) of the drum 50. When being opened, the cover 623 is of a shape along the inner peripheral surface of the drum 50. In the drum 50, the covers 623 in all vessels are opened/closed at the same time by the drive of the drive shaft 622.

Figure 22A:
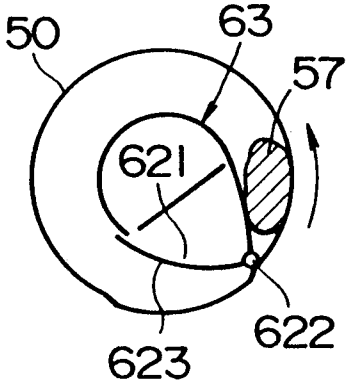
Figure 22B:
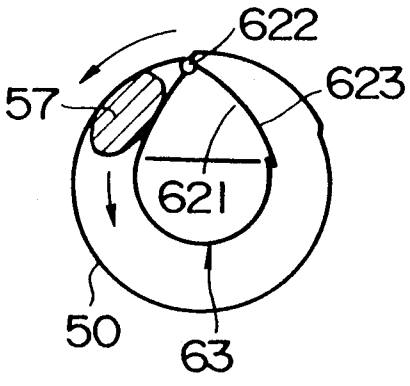
Figure 22C:
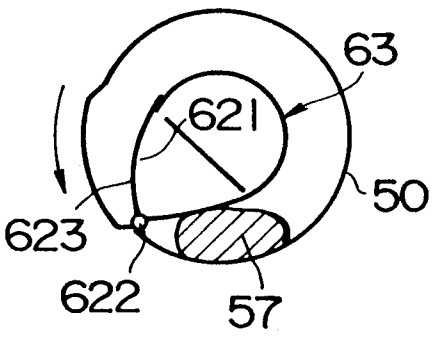
Figure 23A:
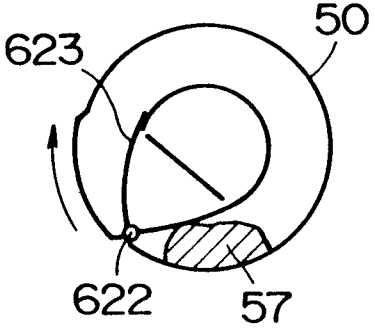
Figure 23B:
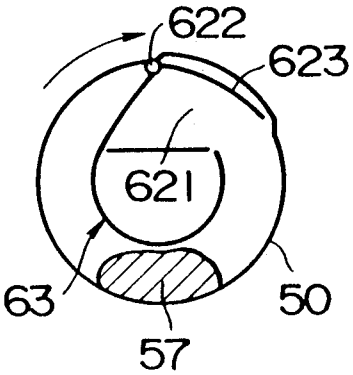
Figure 23C:
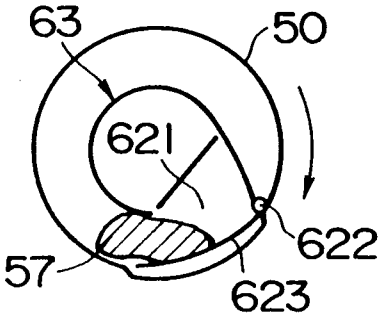
Figure 23D:
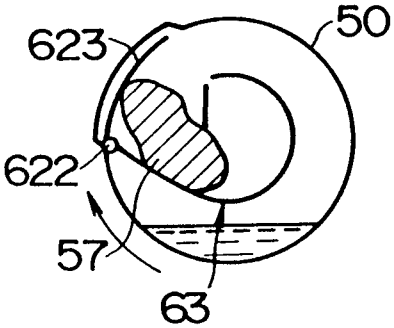
Figure 23E:
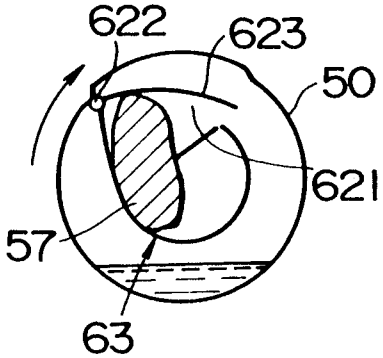
Figure 23F:
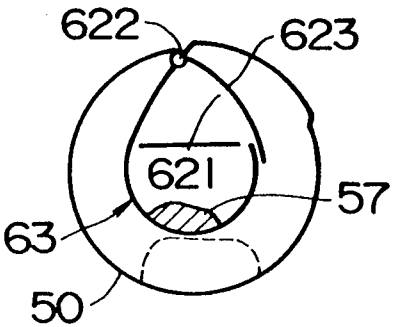

The operation of a continuous washing machine having covers 623 of the above construction will be described with reference to FIGS. 21 through 23. FIGS. 21 and 22 show the motion of drum in the washing operation, and FIG. 23 shows the motion of drum in the transferring operation.

As shown in FIGS. 21 and 22, the cover 623 is closed when washing is performed.

As shown in FIG. 21, when the drum 50 is rotated in the normal direction from the condition of FIG. 21(*a*) to the condition of FIG. 21(*c*) via the condition of FIG. 21(*b*) and then rotated in the reverse direction from the condition FIG. 21(*d*) to the condition of FIG. 21(*f*) via the condition of FIG. 21(*e*), crumple washing is performed by beaters 91 (oscillation washing). In the last condition of normal rotation of drum 50 (FIG. 21(*c*)) and the initial condition of reverse rotation (FIG. 21(*d*)), the wash 57 faces the opening 621, but the wash does not flow into the next vessel through the opening 621 because the opening 621 is covered with the cover 623.

As shown in FIG. 22, when the drum 50 is rotated 360° in the reverse direction from the condition of FIG. 22(*a*) to the condition of FIG. 22(*b*) to that of FIG. 22(*c*), the wash 57 is scooped to a height in the drum by the back surface of the scoop means 36 and then drops; beat washing is performed (raise/drop washing). During this period, the opening 621 is covered with the cover 623.

As shown in FIG. 23, the drum 50 is rotated in the normal direction from the condition of FIG. 23(*a*) and the cover 623 is opened by rotating the drive shaft 622 in the conditions of FIG. 23(*b*) and FIG. 23(*c*). When the drum 50 is further rotated in the normal direction, the wash 57 is scooped up by the scoop means 36 in the conditions of FIG. 23(*c*) and FIG. 23(*d*), and transferred to the next vessel in the condition of FIG. 23(*e*). When the scooping is completed and the wash 57 slips down into the next vessel (the condition of FIG. 23(*e*)), the drive shaft 622 rotates, by which the opening 621 is closed with the cover 623. Since the cover 623 begins to close on the completion of scooping operation (the condition of FIG. 23(*e*)), the scooped wash 57 is pushed in the opening 621, the amount of water contained in the wash 57 being decreased. Therefore, the wash can be transferred surely even if the wash 57 does not slip smoothly or if the wash 57 is bulky.

In the continuous washing machine described above, since the opening 621 can be covered with the cover 623 during the washing operation, there is no possibility that a wash 57 is caught by the opening 621 and some of the wash is transferred. Also, since the cover begins to close on the completion of scooping of wash 57 by the scoop means 63, the wash 57 is pushed in the opening 631, so that the transfer operation is performed surely, and the wash 57 does not block the opening even if the wash 57 does not slip smoothly or if the wash 57 is bulky.

Since the continuous washing machine of the present invention has a cover for opening/closing the scoop-up portion of wash, the cover is closed during the washing operation, so that the wash is not transferred even when the wash faces the scoop-up portion. This eliminates a possibility that the wash in the adjacent vessel is mixed and the capacity of one vessel is exceeded, and prevents insufficient washing and blockage. Since the cover begins to close when the wash is scooped, the wash can be pushed in the opening, so that the transferring operation can be performed surely.

Figure 24:
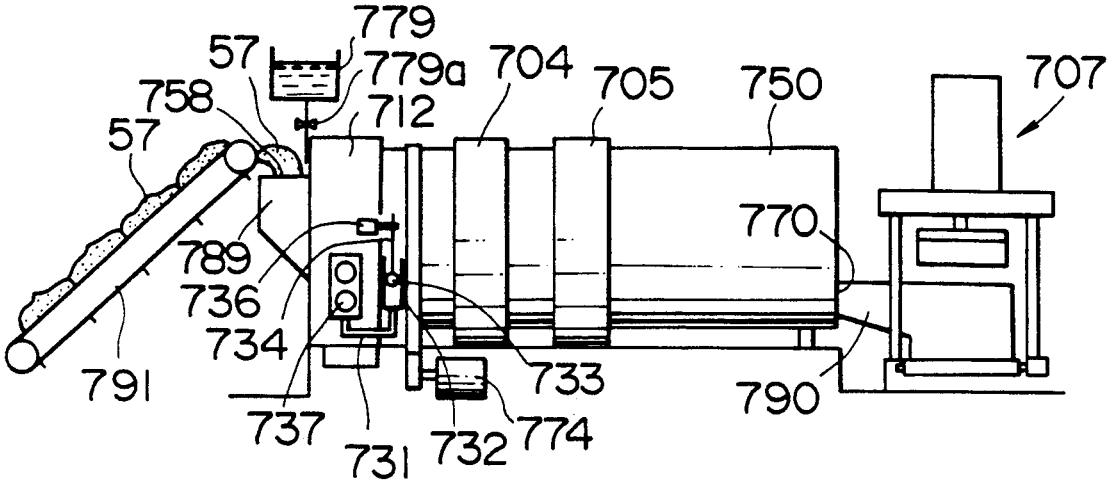
FIG. 24 is a schematic side view of a continuous washing machine in accordance with the present invention.
Figure 25:
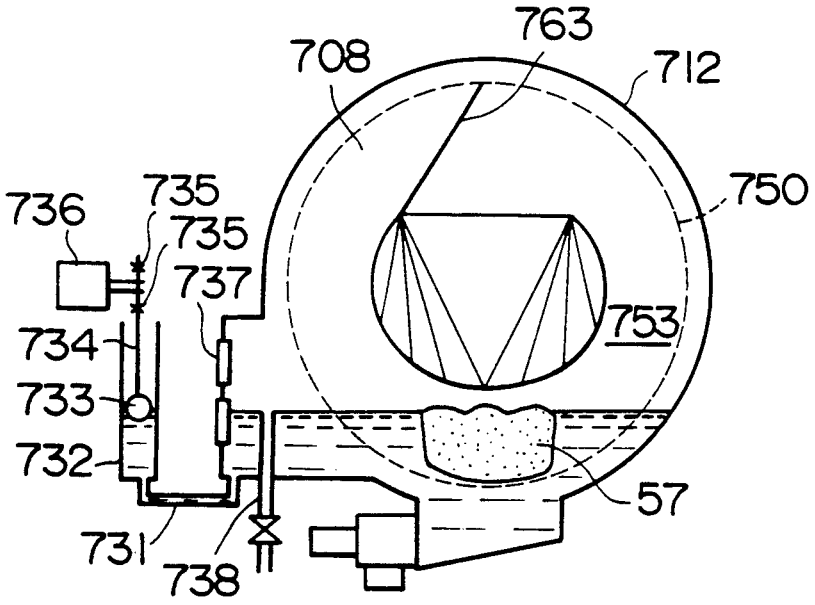
FIG. 25 is a sectional view of the continuous washing machine shown in FIG. 24.

FIGS. 24 and 25 show a detecting means for detecting the supply of wash of an appropriate amount of the drum.

Referring to the figures, a drum 750 is rotated in the predetermined direction by a drive motor 774 to wash a wash 57. Stationary drums 704, 705 are installed outside the drum 750. The supply and discharge of water, the input of detergent, and heating of the drum 750 are performed via the stationary drums 704, 705. At the outlet of drum 750, a dehydrator 707 is installed via a discharge chute 790.

Inside the drum 750, a plurality of vessels including a first vessel 753 are connected in series, and each vessel is separated by a partition plate 708. A scoop means 736 is fixed to the drum 750 and the partition plate 708, so that a wash 57 is scooped up and transferred to the next vessel by the normal rotation of drum 750. A predetermined amount of wash 57 is thrown into the vessel through a charge port 758 in time for transfer. In FIG. 24, reference numeral 779 denotes a water supply tank for supplying pre-washing water (washing water) from the charge port 758, and 779*a* denotes a valve for supplying water.

A wash 57 is weighed for each predetermined amount and carried by a supply conveyor 791. The supply conveyor 791 is driven in time for transfer performed by the rotation of drum 750. The wash 57 is conveyed in the predetermined amounts by using a lift conveyor or a storage bag.

In the continuous washing machine described above, the predetermined amount of wash 57 is thrown into the vessel through the charge port 758, and washing is performed in the vessel sequentially by the oscillation and rotation of drum 750. The pre-washing of the wash 57 is performed in the first vessel 753, and the wash 57 and all of the washing water supplied from the water supply tank 779 are transferred to the next vessel in the transferring operation. Just when the wash 57 is transferred to the next vessel, another wash 57 is thrown through the charge port 758, and the wash 57 taken out of the discharge port 770 is dehydrated with a dehydrator 707.

A certain amount of washing water is supplied from the water supply tank 779 to a stationary pre-washing drum 712. To the stationary pre-washing drum 712 is connected a float chamber 732 via a connecting pipe 731, so that the water level in the stationary pre-washing drum 712 is equal to that of the float chamber 732. A float 733 is disposed as a water level sensor in the float chamber 732, and the float 733 has a detecting rod 734. The detecting rod 734 has dogs 735 indicating the upper and lower limits of water level. When the water level reaches the upper or lower limit, a limit switch 736 activates as a means for detecting abnormality. In FIG. 25, reference numeral 737 denotes a window glass, and 738 denotes an overflow pipe. If a new wash 57 is thrown into the first vessel 753 by the malfunction of supply conveyor 791 when a wash 57 is present in the first vessel 753 during the washing operation, washing water is absorbed into the wash 57, by which the water level in the first vessel 753 in the stationary pre-washing drum 712 is lowered. When the water level in the first vessel is lowered, the water level in the float chamber 732 lowers, so that the limit switch 736 activates via the float 733, the detecting rod 734, and the dog 735. Thus, it is found that a wash 57 exceeding the predetermined amount has been thrown in the first vessel 753, and the machine is stopped at this moment. Therefore, the excess wash 57 can be taken out of the first vessel 753 before the blockage is caused by the wash 57.

By automatically stopping the machine or warning the operator of the abnormality by using a warning lamp or the like when the limit switch 736 activates, the blockage caused by the wash 57 can be surely prevented.

In the continuous washing machine described above, it can be detected that a wash 57 exceeding the predetermined amount has been thrown in the first vessel 753. Therefore, the wash 57 can be taken out of the first vessel, from which the wash can be removed easily, and there is no possibility of blockage in the intermediate vessels caused by the wash 57.

If the wash 57 exceeding the predetermined amount is transferred forcedly to the second or the subsequent vessel and the blockage occurs, the machine is stopped, the temperature in the vessel is decreased, and the atmosphere in the vessel is returned to the normal; then the entangled wash 57 is cut or disentangled to transfer to the discharge port 770 so that the wash 57 is removed from the drum. In the continuous washing machine of this embodiment, in which it is detected in the first vessel 753 that a wash 57 exceeding the predetermined amount has been thrown in, the excess wash can be easily removed without much labor and time even if the wash 57 exceeding the predetermined amount is thrown in.

In the above embodiment, a scoop-type continuous washing machine which transfers a wash 57 from vessel to vessel by using a scoop means 763 was described as an example; however, the present invention can be applied to a spiral-type continuous washing machine which has a partition plate arranged in a spiral form.

Since the continuous washing machine of the present invention has a water level sensor for detecting the water level in the stationary pre-washing drum and an abnormality detecting means for detecting the abnormality of detected value of water level sensor, if a wash exceeding the predetermined amount is thrown into the first vessel, pre-washing water is absorbed by the wash, by which the water level is lowered. Therefore, the detected value of water level sensor becomes abnormal, so that the wash exceeding the predetermined amount thrown into the vessel can be detected. As a result, the excess wash can be removed from the first vessel, and the blockage caused by the wash can be prevented. Even if a wash exceeding the predetermined amount is thrown in, it can be removed easily without much labor and time.

Figure 26:
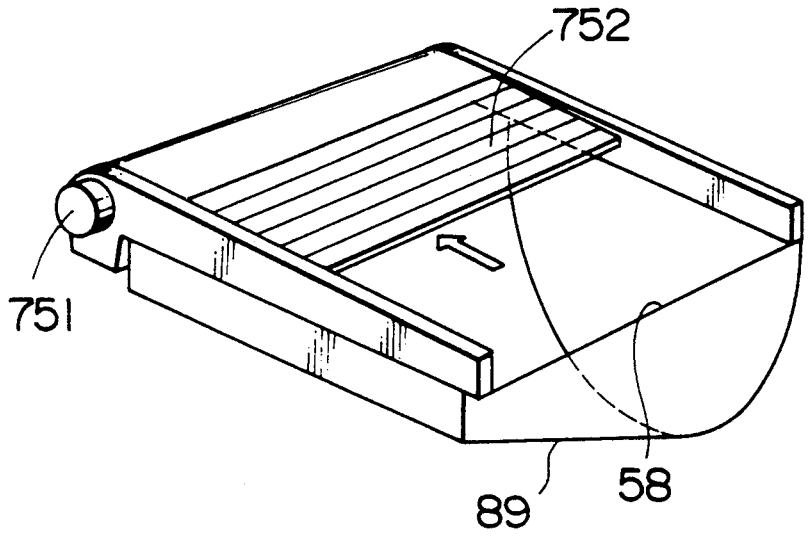
FIG. 26 is a perspective view of a charge port of a continuous washing machine in accordance with the present invention.

FIG. 26 shows a shutter 752 which can be installed at the charge port of the continuous washing machine in accordance with the present invention. The total system construction is the same as that of FIG. 24; therefore, duplicated explanation is omitted.

As shown in FIG. 26, the charge port 758 of a charge chute 789 is covered with the shutter 752, which is opened/closed by the drive of an electric motor 751. The opening/closing of the shutter 752 is controlled in accordance with the transfer timing of the conveyor 791 for supplying a wash 57 to the charge port 758. When a wash is present in the vessel, the shutter 752 closes the charge port 758.

Figure 27:
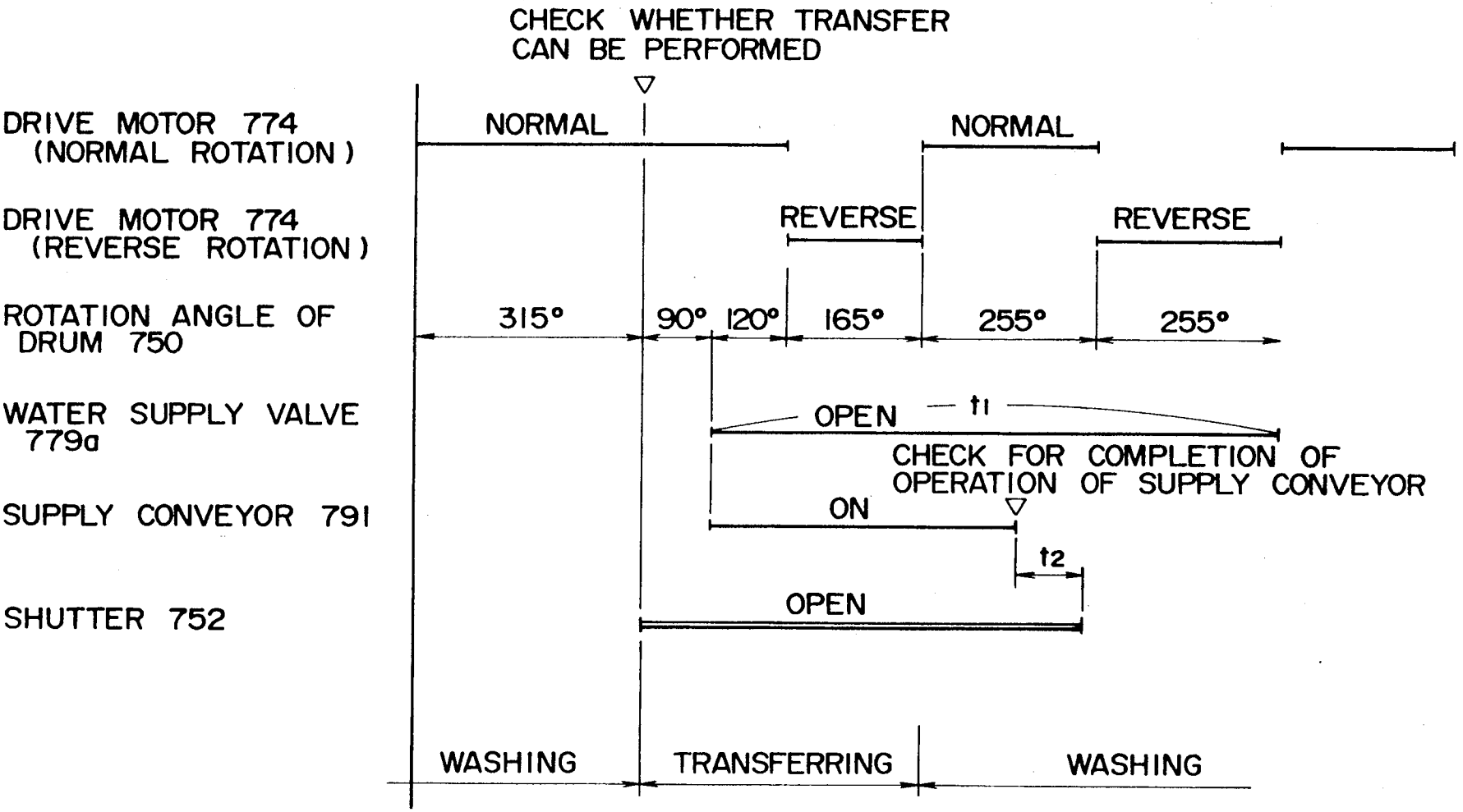
FIG. 27 is a time chart showing the opening/closing condition of a shutter.
Figure 28:
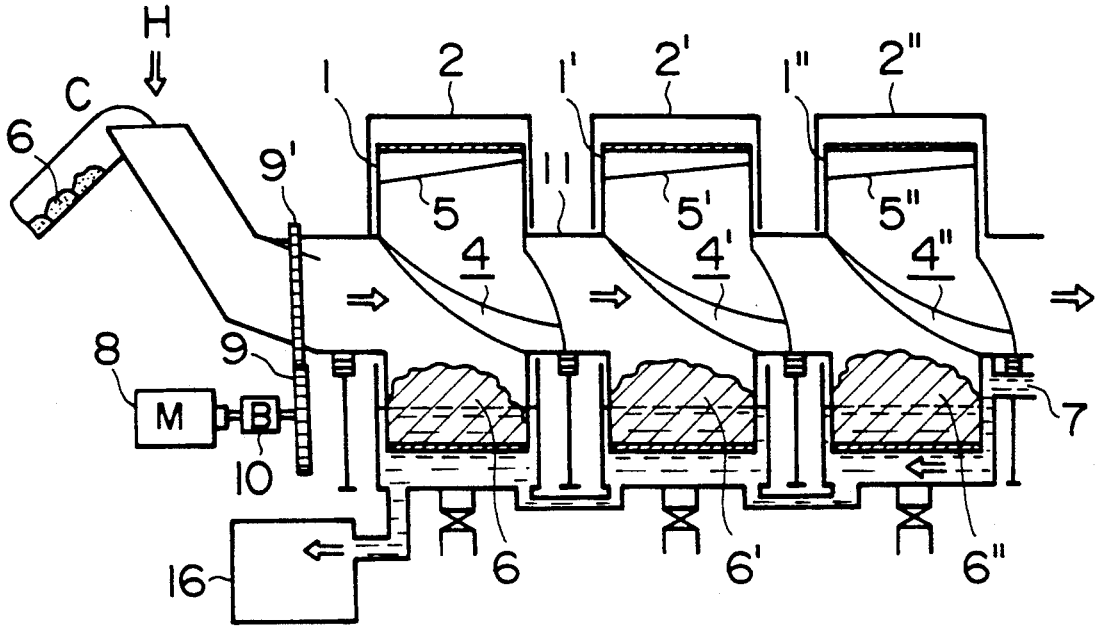
FIG. 28 PRIOR ART
FIG. 28 is a sectional view of a conventional continuous washing machine.
Figure 29:
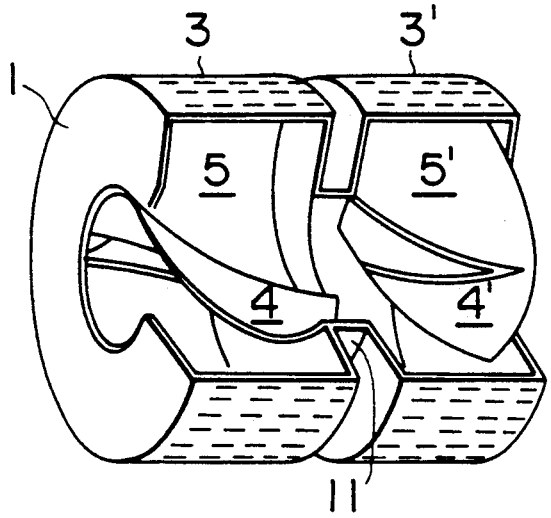
FIG. 29 PRIOR ART
FIG. 29 is a view for illustrating the inside structure of a drum, FIGS. 30(*a*) and 30(*b*) are views for illustrating the motion of a drum.
Figure 30A:
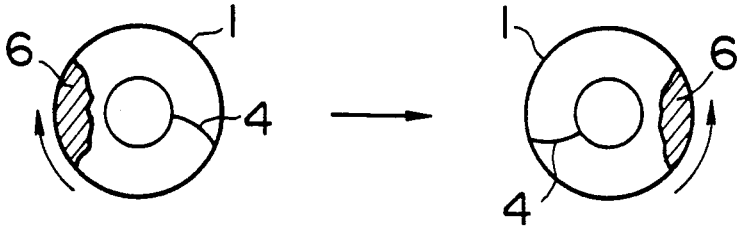
FIG. 30(a) PRIOR ART
Figure 30B:
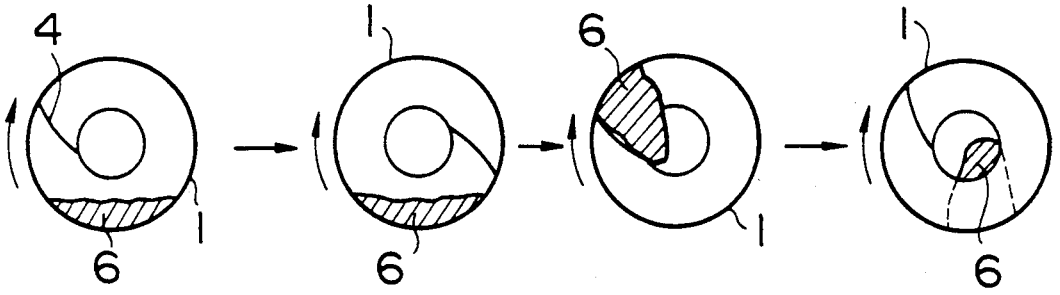
FIG. 30(b) PRIOR ART
Figure 31:
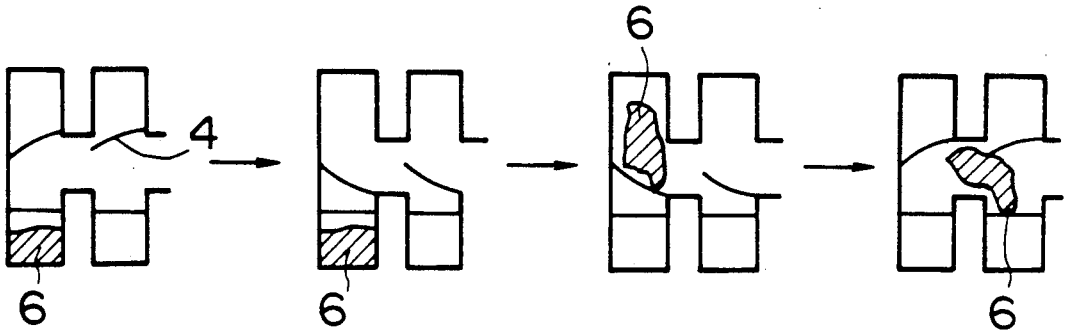
FIG. 31 PRIOR ART
FIG. 31 is a view for illustrating the transfer of a wash.

The open timing of the shutter 752 will be described with reference to FIG. 27.

When the time when the rotation of drum 750 changes from the washing rotation to the transfer rotation (the rotation angle of drum 750 is 315°) is detected and a check whether transfer can be performed is made, for example a check is made that the dehydrator is ready for operation and the water supply tank 779 is full, the shutter 752 is opened. When the drum 750 rotates further (rotation angle 90°) and the supply conveyor 791 begins to operate, the water supply valve **779*a* is opened to start the supply of water (time $t_1$). The shutter 752 remains open until a wash 57 is thrown in through the charge port 758 by the drive of the supply conveyor 791, and time $t_2$ elapses after the completion of operation of the supply conveyor 791 is detected (the completion of throwing of the wash). When the rotation angle of the drum 750 becomes 120°, the drive motor 774 begins to rotate in the reverse direction. After that, washing rotation (oscillation) is performed by repeating the normal and reverse rotations. When the washing rotation is started, the shutter 752** is closed.

Accordingly, the shutter 752 automatically opens from the time when the operation of the supply conveyor 791 starts to the time when the throwing of the wash 57 is completed, and automatically closes when the throwing of the wash is completed. Therefore, even if the supply conveyor 791 malfunctions when a wash 57 is present in the vessel during washing, the wash is not thrown into the vessel through the charge port 758 because the shutter 752 is closed.

When the shape of the closed shutter 752 is convex upward, a wash 57 on the shutter 752 slips down from the top surface of the shutter 752 onto the floor even if the wash 57 drops onto the shutter 752 due to the malfunction of the supply conveyor 791.

In the continuous washing machine having a shutter which is installed at the charge port for wash and opened/closed automatically, a new wash is not thrown into the vessel even if the conveying means malfunctions during washing since the shutter is closed at the time other than the throwing of wash. As a result, there is no possibility that a wash exceeding the allowable amount is thrown into the vessel, and the blockage during transferring can be prevented.

We claim:

1. A continuous washing machine comprising a drum rotatable about an axis and having an inner peripheral surface, a charge port for introducing wash thereto and a discharge port for discharging the wash, partition plates positioned between the charge port and the discharge port, the plates having centrally positioned openings and dividing the interior of said drum into a plurality of vessels, and a scoop means for scooping up wash through the drum while it rotates and sequentially transferring wash through the openings of said plates from the charge port to the discharge port, said scoop means comprising a scoop-up portion which is a flat plate positioned parallel to the axis of rotation of the drum and having an edge portion extending to the inner peripheral surface of the drum, a transfer portion connected to another edge of said scoop-up portion and an edge connected to the next vessel, one edge of said scoop-up portion forming a bent portion at right angles to the inner peripheral surface of said drum.

2. A continuous washing machine comprising a drum rotatable about an axis and having an inner peripheral surface, a charge port for introducing wash thereto and a discharge port for discharging the wash, partition plates positioned between the charge port and the discharge port, the plates having centrally positioned openings and dividing the interior of said drum into a plurality of vessels, and a scoop means for scooping up wash through the drum while it rotates and sequentially transferring wash through the openings of said plates from the charge port to the discharge port, said scoop means comprising a scoop-up portion which is a flat plate positioned parallel to the axis of rotation of the drum and having an edge portion extending to the inner peripheral surface of the drum, a transfer portion connected to another edge of said scoop-up portion and an edge connected to the next vessel, one edge of said scoop-up portion forming a bent portion at right angles to the inner peripheral surface of said drum and further comprising said transfer portion having front and back surfaces, an auxiliary plate positioned on the back surface of the transfer portion substantially flush with the scoop-up portion.

* * * * *